US010843496B2

(12) United States Patent
Murayama et al.

(10) Patent No.: US 10,843,496 B2
(45) **Date of Patent: *Nov. 24, 2020**

(54) MEDIUM

(71) Applicant: BROTHER KOGYO KABUSHIKI KAISHA, Nagoya (JP)

(72) Inventors: Kentaro Murayama, Kasugai (JP); Harumitsu Inoue, Toki (JP); Haruki Matsumoto, Nagoya (JP); Kazuyuki Katagiri, Toyota (JP); Daisuke Baba, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 202 days.

This patent is subject to a terminal disclaimer.

(21) Appl. No.: 16/047,478

(22) Filed: Jul. 27, 2018

(65) Prior Publication Data

US 2019/0030941 A1 Jan. 31, 2019

(30) Foreign Application Priority Data

Jul. 31, 2017 (JP) ..... 2017-147810

(51) Int. Cl.
*B41M 5/50* (2006.01)
*G09F 3/00* (2006.01)
(Continued)

(52) U.S. Cl.
CPC ..... *B41M 5/502* (2013.01); *G09F 3/0295* (2013.01); *G09F 3/10* (2013.01);
(Continued)

(58) Field of Classification Search
CPC ..... B41M 5/502
(Continued)

(56) References Cited

U.S. PATENT DOCUMENTS 6,641,048 B1 11/2003 Schintz et al.
2009/0277570 A1* 11/2009 Caveney ..... G09F 3/0295 156/184
(Continued)

FOREIGN PATENT DOCUMENTS

EP 2 283 477 B1 11/2011
EP 2 631 893 A1 8/2013
JP 2011-524154 A 8/2011

OTHER PUBLICATIONS

Extended European Search Report dated Dec. 10, 2018 in European Patent Application No. 18 18 6365.5.
(Continued)

*Primary Examiner* — Brent T O'Hern
(74) *Attorney, Agent, or Firm* — Scully, Scott, Murphy & Presser, P.C.

(57) ABSTRACT

A medium includes a base layer and a separation layer. First to fifth regions are defined in the medium along a first direction in this order. Portions of the base layer which are in contact with the separation layer are stickable in at least a part of the first region and the fifth region and are not stickable in the second region and the fourth region. A length, in a second direction, of a second-side end portion of the fifth region in the first direction is less than a length, in the second direction, of a first-side end portion of the third region in the first direction. A length, in the second direction, of a first-side end portion of the fifth region in the first direction is less than the length, in the second direction, of the second-side end portion of the fifth region in the first direction.

9 Claims, 15 Drawing Sheets

(51) Int. Cl.
*G09F 3/10* (2006.01)
*G09F 3/02* (2006.01)

(52) U.S. Cl.
CPC ..... *G09F 2003/0251* (2013.01); *G09F 2003/0257* (2013.01); *G09F 2003/0266* (2013.01)

(58) Field of Classification Search
USPC ..... 428/43
See application file for complete search history.

(56) References Cited

U.S. PATENT DOCUMENTS

| | | | | |
|---|---|---|---|---|
| 2012/0308756 | A1 | 12/2012 | Caveney et al. | |
| 2013/0305576 | A1 | 11/2013 | Takashima et al. | |
| 2015/0007929 | A1 | 1/2015 | Caveney et al. | |
| 2016/0012755 | A1 | 1/2016 | Takashima et al. | |
| 2017/0004740 | A1 | 1/2017 | Caveney et al. | |
| 2018/0282583 | A1* | 10/2018 | Inoue | B32B 3/16 |

OTHER PUBLICATIONS

Abstract Only of WO 2009/137756 (which corresponds to EP 2 283 477).
European Office Action dated Apr. 24, 2020 received in European Application No. 18 186 365.5.

* cited by examiner

A01
XIVB
XIVB
W
L1
L2
WA
WB
M1
M2
m1
m2
D1
D2a
D2b
D3
D4
D5
D4R
D4L
R
L
X1
X2A
X2B
X3
X4
B
C
H
21
22
23
25
302

A01
XVB
XVB
W
L1
L2
WA
WB
X1
X2A
X2B
X3
X4
D1
D2a
D2b
D3
D4
D5
D4R
D4L
M1
M2
m1
m2
G
R
L
H
LD
21
22
23
25
302
B
C

MEDIUM

CROSS REFERENCE TO RELATED APPLICATION

The present application claims priority from Japanese Patent Application No. 2017-147810, which was filed on Jul. 31, 2017, the disclosure of which is herein incorporated by reference in its entirety.

BACKGROUND

The following disclosure relates to a medium to be attached to a wrapped member.

There is known a medium to be attached to an outer circumferential portion of a cable or a circular cylindrical wrapped member, for example. This medium includes a base layer, an adhesive layer, and a separation layer stacked on each other. The medium includes: a one-side adhesive region in which a back surface of the medium becomes adhesive after the separation layer is peeled off; a non-adhesive region which is contiguous to the one-side adhesive region and in which a printing background layer is provided, and the back surface of the medium is not stickable; and an other-side adhesive region which is contiguous to the non-adhesive region and in which the back surface of the medium is partly adhesive.

SUMMARY

In this conventional medium, the back surface (i.e., an inner circumferential surface) of the portion of the medium in the one-side adhesive region is first stuck to the outer circumferential portion of the wrapped member with adhesive. The portion of the medium in the non-adhesive region contiguous to the one-side adhesive region is then wrapped around the wrapped member so as to form a cylindrical member. The back surface (i.e., the inner circumferential surface) of the portion of the medium in the other-side adhesive region is then stuck to an outer circumferential surface of the portion of the medium in the non-adhesive region with adhesive. A user then breaks the medium along perforation formed in advance between the one-side adhesive region and the non-adhesive region in a state in which the portions of the medium in the one-side adhesive region and the non-adhesive region adhere to the wrapped member. As a result, a unit of the portions of the medium in the non-adhesive region and the other-side adhesive region is separated from the portion of the medium in the one-side adhesive region, whereby the cylindrical medium rotatable around the wrapped member (i.e., a rotational label) is completed.

However, since the above-described wrapping is manually performed by the user, a direction of the wrapping may be unfortunately displaced in the axial direction of the cylindrical member, which may cause contact between the wrapped member and adhesive on a wrapping-end portion of the label (the wrapping-end end portion of the other-side adhesive region).

Accordingly, an aspect of the disclosure relates to a medium capable of reducing contact of adhesive on a wrapping-end portion of the medium, with a wrapped member.

In one aspect of the disclosure, a medium includes a base layer and a separation layer stacked on each other in a stacking direction. A plurality of regions are defined in the medium along a first direction orthogonal to the stacking direction. The plurality of regions include: a first region in which a portion of the base layer which is in contact with the separation layer is stickable in at least a part of the first region in a second direction orthogonal to each of the stacking direction and the first direction; a second region located on a first side of the first region in the first direction, the first side being opposite to a second side in the first direction, a printing background layer being provided in the second region, a portion of the base layer, which is located in the second region and is in contact with the separation layer, being not stickable; a third region located on the first side of the second region in the first direction; a fourth region located on the first side of the third region in the first direction, a portion of the base layer, which is located in the fourth region and is in contact with the separation layer, being not stickable; and a fifth region located on the first side of the fourth region in the first direction, a portion of the base layer, which is located in the fifth region and is in contact with the separation layer, being stickable. A length, in the second direction, of a second-side end portion of the fifth region in the first direction is less than a length, in the second direction, of a first-side end portion of the third region in the first direction. A length, in the second direction, of a first-side end portion of the fifth region in the first direction is less than the length, in the second direction, of the second-side end portion of the fifth region in the first direction.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings.

Label Creating Apparatus

There will be described a label creating apparatus according to the present embodiment with reference to FIG. 1.

Figure 1:
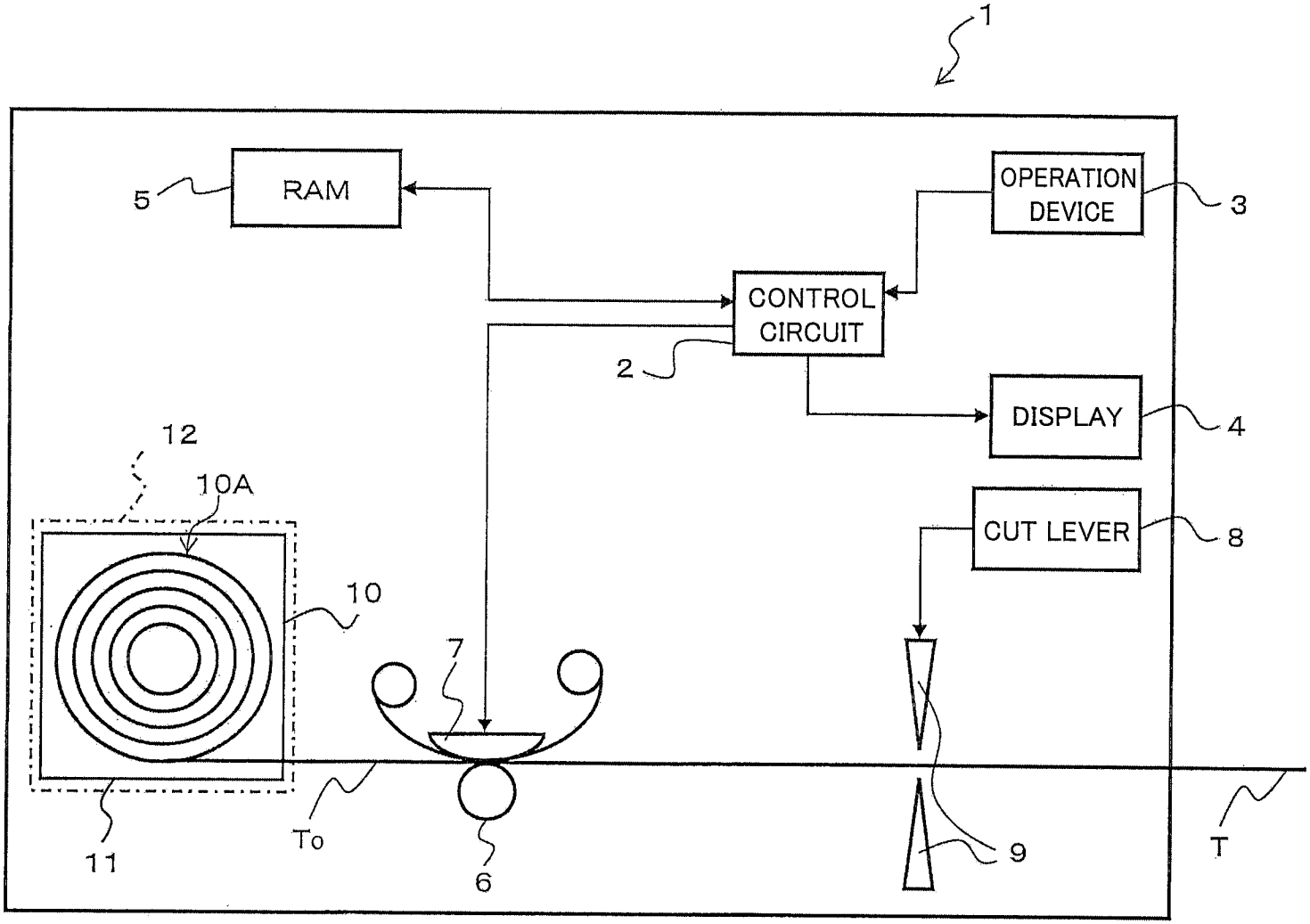
FIG. 1 is a view for explaining a general structure of a label creating apparatus according to one embodiment.

In FIG. 1, a label creating apparatus 1 as one example of a printing apparatus includes: a control circuit 2; an operation device 3 configured to accept operations of a user (an operator); a display 4; a random-access memory (RAM) 5 configured to store various kinds of information; a conveying roller 6 as one example of a conveyor; a print head 7 as one example of a printing device; a cut lever 8; and cutters 9.

The label creating apparatus 1 includes a cartridge holder 12 having a housing 11, on which a tape cartridge 10 is mountable removably. The tape cartridge 10 accommodates a tape roll 10A having a spiral shape. It is noted that FIG. 1 illustrates the tape roll 10A in the form of concentric circles for simplicity. The tape roll 10A is a roll of a print tape To as one example of a tape. Examples of the tape cartridge 10 include: a tape cartridge of a die-cut-label type in which the print tape To having half-cut regions HC (see FIGS. 2A and 2B which will be described below) formed by half cut (kiss cut) of the print tape To is rolled; and a tape cartridge of what is called a continuous type, not illustrated, in which the print tape To having no half-cut regions HC is rolled. In the label creating apparatus 1, any of the types of the tape cartridge 10 may be used. It is noted that the following description is provided assuming that the tape cartridge 10 of the die-cut-label type is used, unless otherwise specified.

The control circuit 2 includes a central processing unit (CPU) and a read-only memory (ROM), not illustrated. The control circuit 2 is configured to execute various programs stored in the ROM and control overall operations of the label creating apparatus 1 while using a temporary storage function of the RAM 5.

The conveying roller 6 is opposed to the print head 7. The print tape To fed from the tape roll 10A is nipped between the conveying roller 6 and the print head 7. The conveying roller 6 is rotated to convey the print tape To while drawing the print tape To out from the tape roll 10A.

The print head 7 is configured to print a desired print object, such as characters and figures, on each of label portions (which will be described later in detail) of the print tape To conveyed by the conveying roller 6.

The cutters 9 are actuated by user's operation of the cut lever 8 to cut a print tape T (which will be described later in detail) on which a plurality of print labels L are printed along a conveying direction.

Print Tape

Figure 2A:
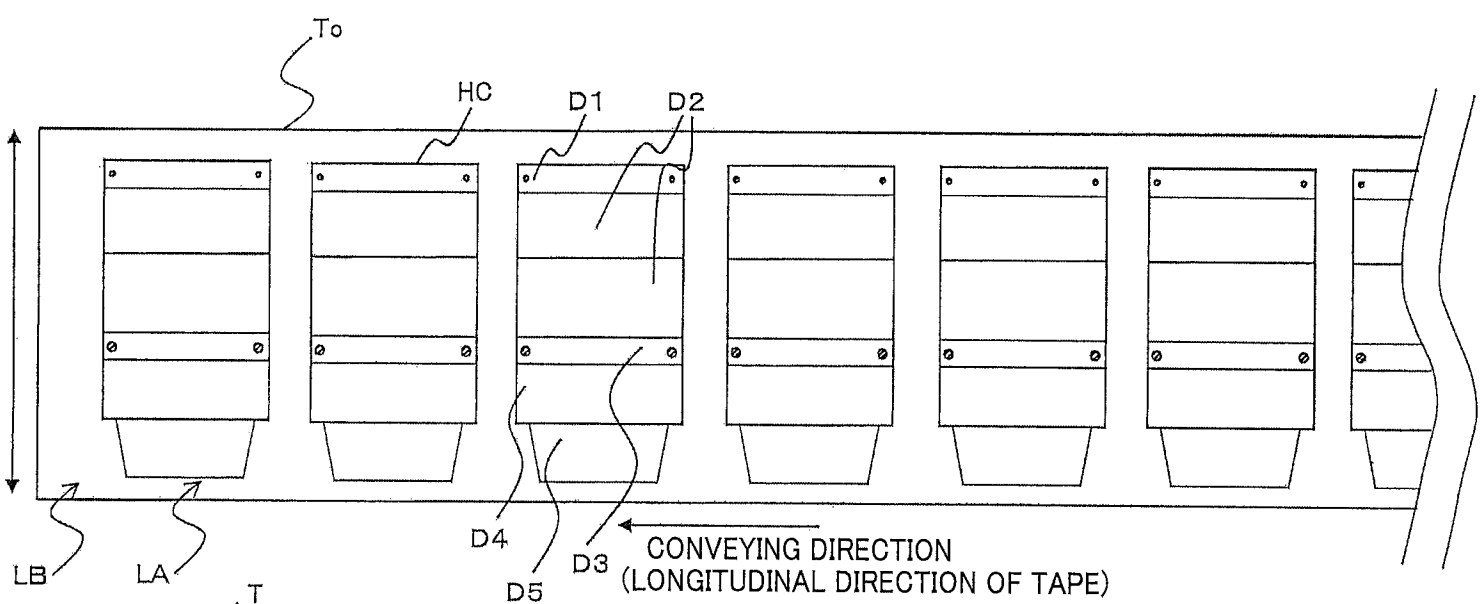
FIG. 2A is a plan view illustrating a print tape before printing.

FIG. 2A illustrates the print tape To. FIG. 2A is a plan view of the print tape To in an unprinted state. In FIG. 2A, the right and left direction coincides with the conveying direction (in other words, the longitudinal direction of the tape), the up and down direction coincides with the widthwise direction of the tape, and the front and back direction of the sheet on which FIG. 2A is illustrated coincides with the thickness direction of the tape. In FIG. 2A, the print tape To has substantially rectangular half-cut regions HC (see FIG. 3B) formed by cutting a base layer 21 and an adhesive layer 22. Portions of the print tape To inside the half-cut regions HC are label portions LA as one example of a medium, and a portion of the print tape To outside the half-cut regions HC is a non-label portion LB. It is noted that a print tape from which the non-label portion LB is peeled off in advance may be used as the print tape To. The label portions LA are arranged in the longitudinal direction of the tape. Each of the label portions LA includes an adhesive region D1, a non-adhesive region D2 (a non-adhesive region D2*a* and a non-adhesive region D2*b*), a non-adhesive region D3, a non-adhesive region D4, and an adhesive region D5 arranged in order toward one side in the widthwise direction of the tape (downward in FIG. 2A). These regions will be described later.

Figure 2B:
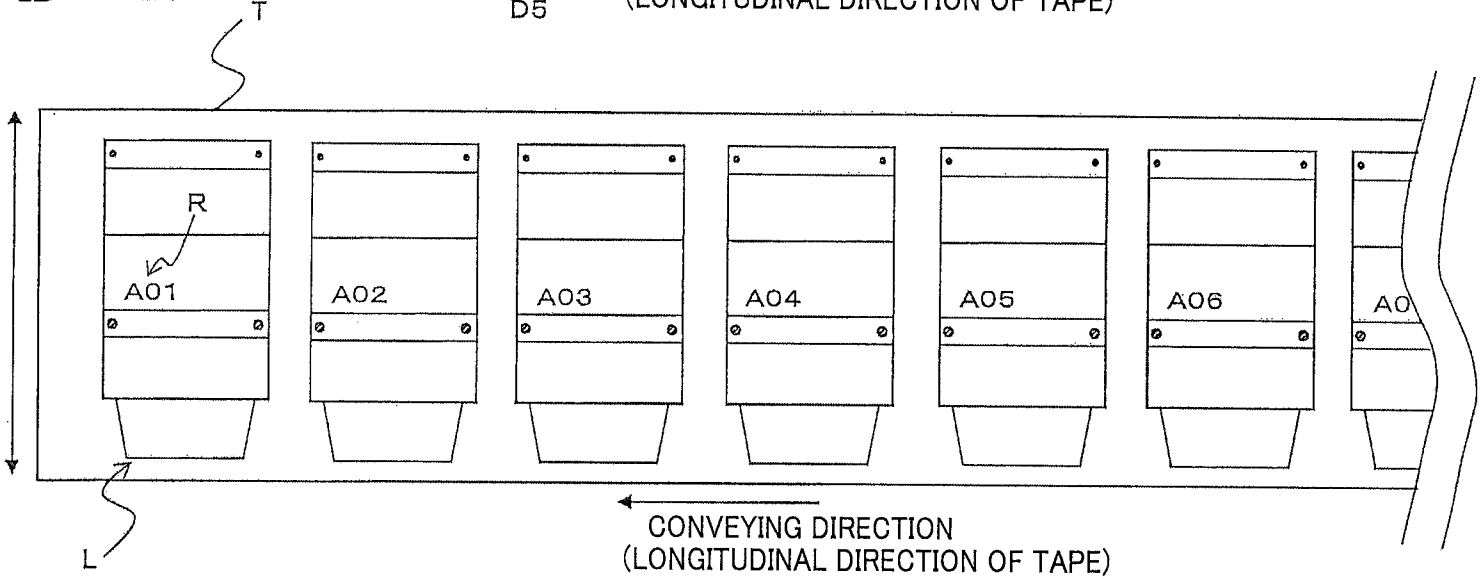
FIG. 2B is a plan view illustrating the print tape after printing.

FIG. 2B illustrates the print tape T on which character strings R are formed. In this example, FIG. 2B is a plan view of the print tape T after the character strings R are respectively printed on the non-adhesive region D2*a* of the regions D1-D5. In this example, as illustrated in FIG. 2B, text objects as the print objects, i.e., the character strings R ("A01", "A02", "A03", and so on) are formed in order by the print head 7 on the respective label portions LA to create the print labels L.

Print Label

Figure 3B:
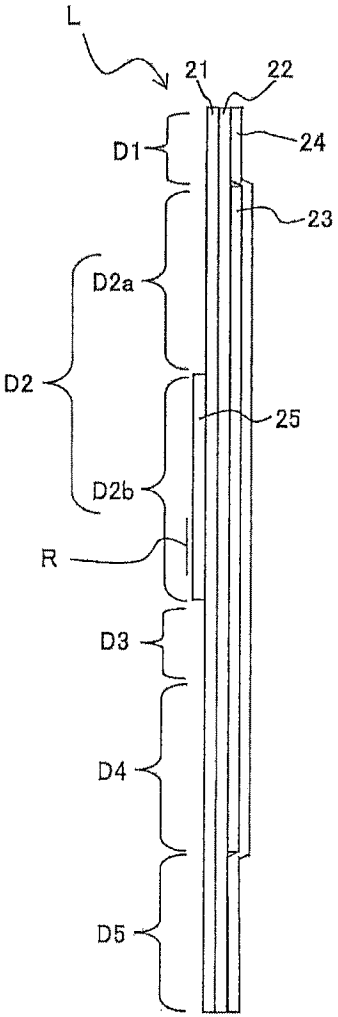
FIG. 3B is a cross-sectional view taken along line IIIB-IIIB in FIG. 3A.
Figure 3A:
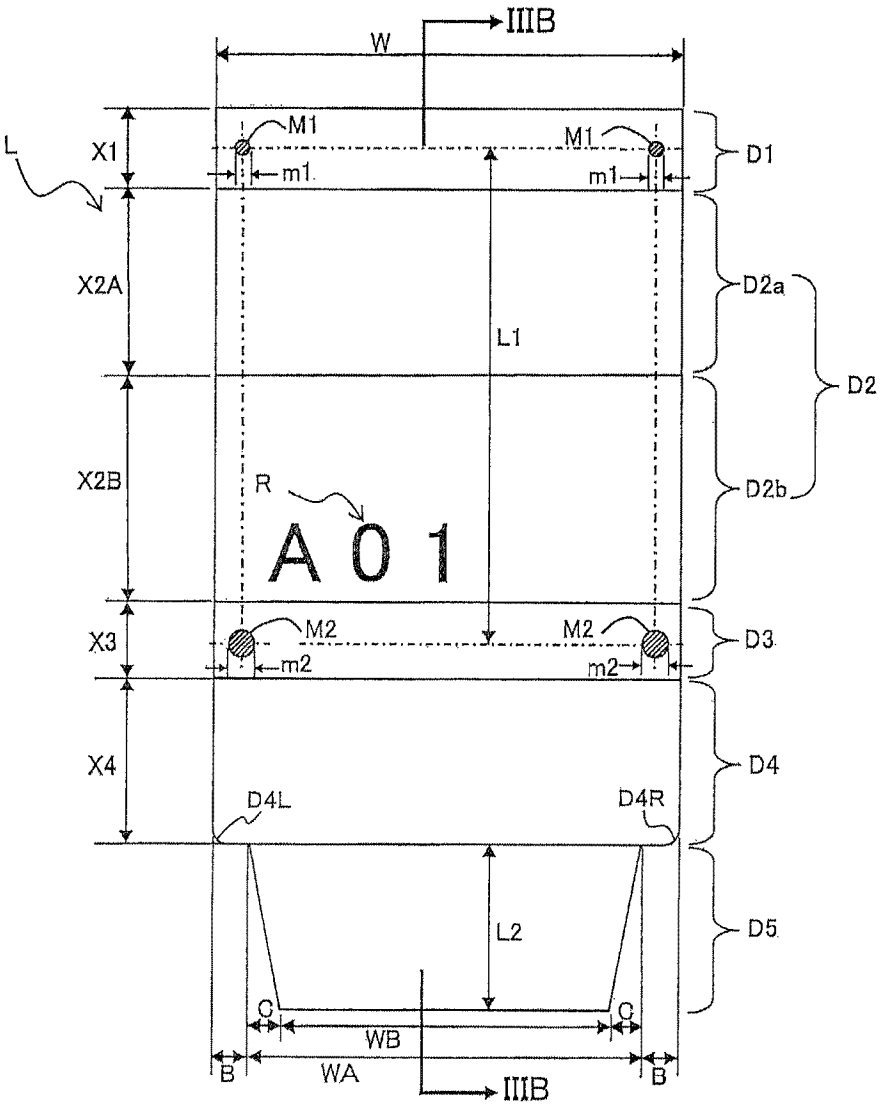
FIG. 3A is a developed plan view of a print label.

There will be next described the structure of the print label L with reference to FIGS. 3A and 3B. FIG. 3A is a plan view of one print label L separated from the non-label portion LB. FIG. 3B is a cross-sectional view taken along line IIIB-IIIB in FIG. 2B.

In FIGS. 3A and 3B, each of the print labels L is constituted by the transparent base layer 21, the transparent adhesive layer 22, a transparent non-adhesive layer 23, and a separation layer 24 which are stacked on one another from the left side toward the right side in FIG. 3B (from the front side toward the back side in FIG. 3A) in a thickness direction of the print label L (i.e., the depth direction of the sheet in FIG. 3A and the right and left direction in FIG. 3B). The thickness direction is one example of a stacking direction in which the layers are stacked on one another. It is noted that since each of the print tapes To, T has this stacking structure, each of the print tapes To, T has the base layer 21, the adhesive layer 22, the non-adhesive layer 23, and the separation layer 24 each elongated in the right and left direction in FIGS. 2A and 2B (as one example of a second direction orthogonal to each of a first direction and the thickness direction).

A printing background layer 25 having a non-transparent color on which the character string R is formed by the print head 7 is provided on a portion of a front surface of the base layer 21 (i.e., a left surface thereof in FIG. 3B which is a one-side surface thereof in the thickness direction). The non-adhesive layer 23 is provided between a portion of the adhesive layer 22 and a portion of the separation layer 24. While the adhesive layer 22 is provided on the entire back surface of the base layer 21 (i.e., a right surface in FIG. 3B which is an other-side surface thereof in the thickness direction) between the base layer 21 and the separation layer 24 in this example, the adhesive layer 22 may be provided on a portion of the back surface of the base layer 21.

In view of the above, the print label L has the five regions along the direction orthogonal to the thickness direction (i.e., the up and down direction in FIGS. 3A and 3B, the circumferential direction of a wrapped member 302 which will be described below, and the first direction). The five regions include: the adhesive region D1 (as one example of a first region) constituting an upper end portion of the print label L in FIGS. 3A and 3B in the first direction (noted that the upper side in FIGS. 3A and 3B may be referred to as "the other side in the first direction"); the non-adhesive region D2*a* located contiguous to and under the adhesive region D1 in FIGS. 3A and 3B (noted that the lower side in FIGS. 3A and 3B may be referred to as "one side in the first direction" which is one example of a first side); the non-adhesive region D2*b* located contiguous to and under the non-adhesive region D2*a* in FIGS. 3A and 3B (noted that the non-adhesive region D2 constituted by the non-adhesive region D2*a* and the non-adhesive region D2*a* is one example of a second region); the non-adhesive region D3 (as one example of a third region) located contiguous to and under the non-adhesive region D2*b* in FIGS. 3A and 3B; the non-adhesive region D4 (as one example of a fourth region) located contiguous to and under the non-adhesive region D3 in FIGS. 3A and 3B; and the adhesive region D5 (as one example of a fifth region) located contiguous to and under the non-adhesive region D4 in FIGS. 3A and 3B and constituting a lower end portion of the print label L in FIGS. 3A and 3B in the first direction.

In the adhesive region D1, the base layer 21, the adhesive layer 22, and the separation layer 24 are stacked in this order from the one side toward the other side in the thickness direction (from the left side toward the right side in FIG. 3B). Thus, the entire portion of the base layer 21 in the adhesive region D1 which is in contact with the separation layer 24 has adhesiveness (as one example of adhesion) owing to the adhesive layer 22. This adhesive region D1 has a substantially rectangular shape in plan view which has the length X1 in the first direction and the length W in the second direction (see FIG. 3A). The configuration in the adhesive region D1 is not limited to that in which the adhesive layer 22 is provided in the entire adhesive region D1 in the second direction. That is, the adhesive layer 22 only needs to be provided on opposite end portions of the adhesive region D1 in the second direction. For example, the adhesive layer 22 may not be provided between the opposite end portions of the adhesive region D1 in the second direction.

The non-adhesive region D2 includes: the non-adhesive region D2*a* located contiguous to and on the one side of the adhesive region D1 in the first direction; and the non-adhesive region D2*b* located contiguous to and on the one side of the non-adhesive region D2*a* in the first direction.

In the non-adhesive region D2*a*, the base layer 21, the adhesive layer 22, the non-adhesive layer 23, and the separation layer 24 are stacked in order from the one side toward the other side in the thickness direction (from the left side toward the right side in FIG. 3B). Thus, the entire portion of the base layer 21 in the non-adhesive region D2*a* which is in contact with the separation layer 24 is not adhesive (as one example of non-adhesiveness) because the adhesiveness of the adhesive layer 22 is interrupted by the non-adhesive layer 23. The non-adhesive region D2*a* has a substantially rectangular shape in plan view which has the length X2A in the first direction and the length W in the second direction.

In the non-adhesive region D2*b*, the printing background layer 25, the base layer 21, the adhesive layer 22, the non-adhesive layer 23, and the separation layer 24 are stacked in order from the one side toward the other side in the thickness direction (from the left side toward the right side in FIG. 3B). Thus, the entire portion of the non-adhesive region D2*b* which is in contact with the separation layer 24 is not adhesive because the adhesiveness of the adhesive layer 22 is interrupted by the non-adhesive layer 23. In this example, the printing background layer (ink coated layer) 25 is formed by coating the base layer 21 with ink of an appropriate color, for example. The character string R (the text "A01") is formed by the print head 7 on the printing background layer 25. The non-adhesive region D2*b* has a substantially rectangular shape in plan view which has the length X2B in the first direction and the length W in the second direction (see FIG. 3A).

In the non-adhesive region D3, the base layer 21, the adhesive layer 22, the non-adhesive layer 23, and the separation layer 24 are stacked in order from the one side toward the other side in the thickness direction (from the left side toward the right side in FIG. 3B). Thus, the entire portion of the base layer 21 in the non-adhesive region D3 which is in contact with the separation layer 24 is not adhesive because the adhesiveness of the adhesive layer 22 is interrupted by the non-adhesive layer 23. The non-adhesive region D3 has a substantially rectangular shape in plan view which has the length X3 in the first direction and the length W in the second direction (see FIG. 3A).

In the non-adhesive region D4, the base layer 21, the adhesive layer 22, the non-adhesive layer 23, and the separation layer 24 are stacked in order from the one side toward the other side in the thickness direction (from the left side toward the right side in FIG. 3B). Thus, the entire portion of the base layer 21 in the non-adhesive region D4 which is in contact with the separation layer 24 is not adhesive because the adhesiveness of the adhesive layer 22 is interrupted by the non-adhesive layer 23. The non-adhesive region D4 has a substantially rectangular shape in plan view which has the length X4 in the first direction and the length W in the second direction (see FIG. 3A). A one-side end portion of the non-adhesive region D4 in the first direction (a lower end portion of the non-adhesive region D4 in FIG. 3A) has curved portions D4L, D4R respectively at opposite end portions of the one-side end portion in the second direction (i.e., at left and right end portions in FIG. 3A). Each of the curved portions D4L, D4R is formed by chamfering the opposite end portions of the one-side end portion. While similar curved portions are provided in structures illustrated in FIGS. 10A-15A which will be described below, illustration of the curved portions is omitted for simplicity.

In the adhesive region D5, the base layer 21, the adhesive layer 22, and the separation layer 24 are stacked in this order from the one side toward the other side in the thickness direction (from the left side toward the right side in FIG. 3B). Thus, at least a part of a portion of the base layer 21 in the adhesive region D5, which portion is in contact with the separation layer 24, has adhesiveness owing to the adhesive layer 22. It is noted that a dimensional relationship of the adhesive region D5 will be described later in detail.

It is noted that a well-known release processing (release treatment) is applied at least to a surface of the separation layer 24 which is in contact with the adhesive layer 22 in the adhesive region D1 and to a surface of the separation layer 24 which is in contact with the adhesive layer 22 in the adhesive region D5. As a result, when the separation layer 24 is peeled off, the adhesive layer 22 clings to the base layer 21 and is kept unseparated therefrom at least in the adhesive region D1 and the adhesive region D5. The base layer 21 does not have perforation or slits (except the half-cut regions HC), and the cross-sectional shape of the base layer 21 in the thickness direction is continuous in the first direction.

In the present embodiment, two first marks M1 as print marks (each as one example of a first mark) are printed on the print label L respectively at positions in the adhesive region D1 which are spaced apart from each other in the right and left direction in FIG. 3A (i.e., the second direction). Also, two second marks M2 as print marks (each as one example of a second mark) are printed on the print label L respectively at positions in the non-adhesive region D3 which are spaced apart from each other in the right and left direction in FIG. 3A (i.e., the second direction).

The first marks M1 and the second marks M2 are respectively aligned in the up and down direction in FIG. 3A (i.e., the first direction). That is, the center of the left first mark M1 in FIG. 3A and the center of the left second mark M2 in FIG. 3A are arranged in the up and down direction in FIG. 3A (i.e., the first direction), and the center of the right first mark M1 in FIG. 3A and the center of the right second mark M2 in FIG. 3A are arranged in the up and down direction in FIG. 3A (i.e., the first direction). It is noted that the dimensional relationship between the marks M1, M2 will be described later.

While the first marks M1 and the second marks M2 are printed in the above-described example, the present disclosure is not limited to this configuration. For example, one or both of each of the first marks M1 and each of the second marks M2 may be openings (through holes or holes each having a closed bottom).

Procedure of Attachment of Print Label to Wrapped Member

Figure 4A:
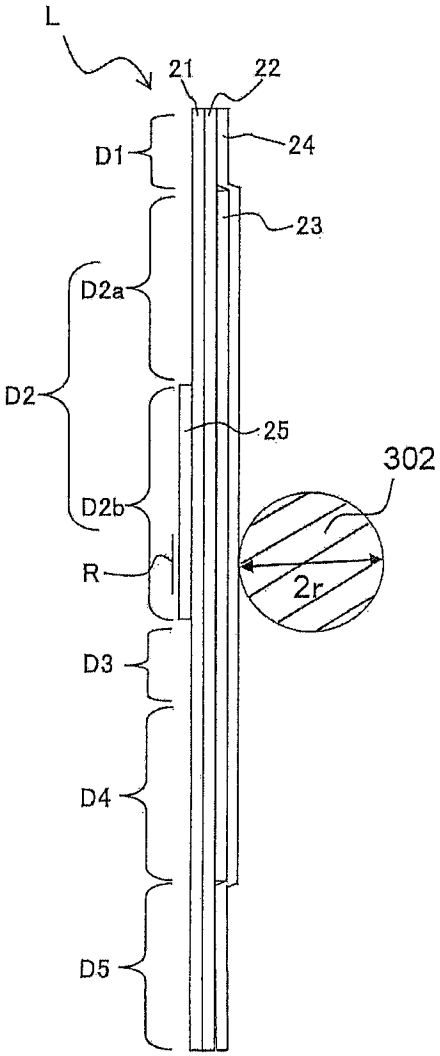
FIGS. 4A through 4C are views for explaining a procedure of attachment of the print label to a wrapped member.
Figure 4B:
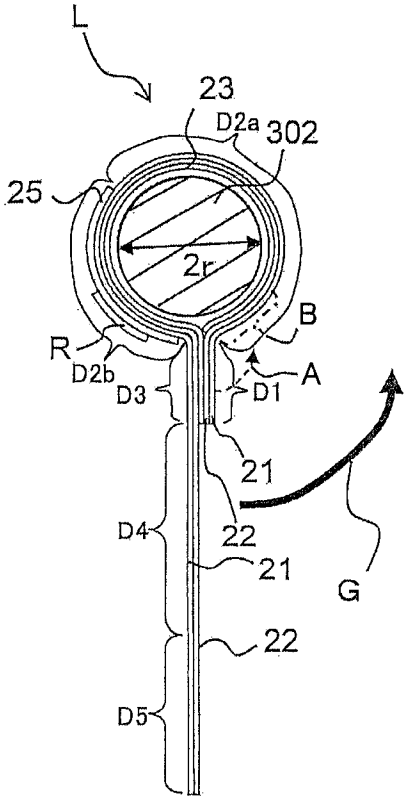
Figure 4C:
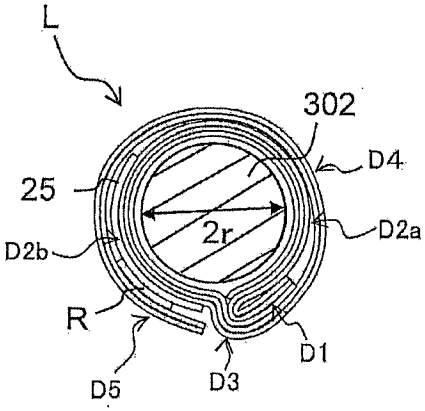

FIGS. 4A-4C illustrate one example of a procedure of attachment of the print labels L to the wrapped member. In this example, FIGS. 4A-4C illustrate one example of wrapping the print label L around the wrapped member 302 shaped like a circular cylinder or a cable and having the radius r (the diameter 2r).

As illustrated in FIG. 4A, the separation layer 24 is first peeled off from the print label L having the above-described structure to expose the non-adhesive layer 23. While the print label L is constituted by the adhesive region D1, the non-adhesive region D2*a*, the non-adhesive region D2*b*, the non-adhesive region D3, the non-adhesive region D4, and the adhesive region D5 arranged in this order, the portions of the print label L in the adhesive region D1, the non-adhesive region D2*a*, and the non-adhesive region D2*b* are then bent in a concave shape such that a portion of the print label L which had been in contact with the separation layer 24 (a right portion of the print label L in FIG. 4A) is located on an inner side (not illustrated).

As illustrated in FIG. 4B, the wrapped member 302 is placed on an inner portion of the concave portion of the print label L, and the print label L is wrapped around the wrapped member 302 so as to form a cylindrical member surrounding the wrapped member 302. Then, the adhesive layer 22 in the adhesive region D1 as a part of a distal end portion of the print label L (noted that the adhesive layer 22 in the adhesive region D1 serves as a sticking portion in inner-sides sticking which will be described below) and the non-adhesive layer 23 in the non-adhesive region D3 (which serves as a stuck portion in the inner-sides sticking which will be described below) are stuck together. This sticking may be hereinafter referred to as "inner-sides sticking". In this state, the sum of the lengths X2, X3, and X4 of the non-adhesive layer 23 in the first direction is at least greater than or equal to the circumference of a circle $2\pi r$ of the wrapped member 302. As a result, the shape of the print label L is fixed by sticking of the portions of the adhesive layer 22 and the non-adhesive layer 23, and the print label L is wrapped around the wrapped member 302 in the non-adhesive region D2*a* and the non-adhesive region D2*b* without adhesive, whereby the print label L is rotatably attached to the wrapped member 302.

Thereafter, the non-adhesive region D4 and the adhesive region D5 not used for surrounding the wrapped member 302 is wrapped around an outer circumferential portion of the print label L in the non-adhesive region D2*a* and the non-adhesive region D2*b* (see FIG. 4C) so as to cover the non-adhesive region D2*a* and the non-adhesive region D2*b* constituting the cylindrical member in this order such that the stuck portions of the print label L in the adhesive region D1 and the non-adhesive region D3 are folded into an inner circumferential side as indicated by the arrow G in FIG. 4B (such that the adhesive region D1 as the sticking portion is folded along the arrow A and brought into contact with an area B in FIG. 4B). The portion of the print label L in the adhesive region D5 is stuck to the outer circumferential portion of the print label L in the non-adhesive region D2*b* using adhesiveness of the adhesive layer 22, and the attachment of the print label L to the wrapped member 302 is finished.

Example of Use of Print Label

Figure 5:
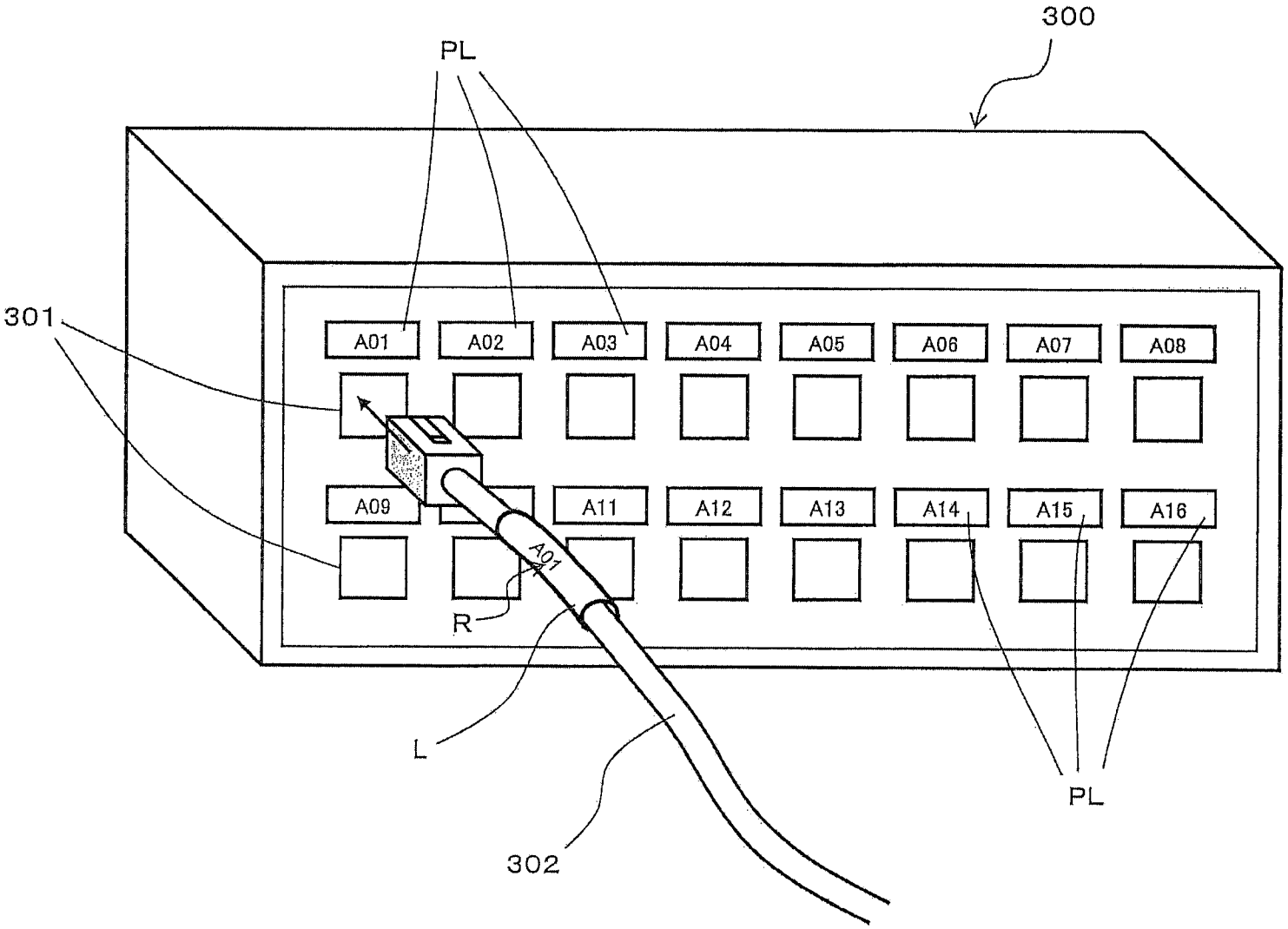
FIG. 5 is a perspective view illustrating an example of use of the print labels.

FIG. 5 illustrates one example of use of the print labels L. In this example, cables used for a switching hub configured to relay information over a wired LAN are used each as the wrapped member 302. These cables will be hereinafter referred to as "cables 302". As illustrated in FIG. 5, a switching hub 300 has sixteen slots 301, eight of which are formed in an upper portion of the switching hub 300, and the other eight of which are formed in a lower portion of the switching hub 300. In the illustrated example, plates PL indicating identification names "A01"-"A08" are provided respectively for the upper eight slots 301 so as to be arranged in this order from the left. Also, plates PL indicating identification names "A09"-"A16" are provided respectively for the lower eight slots 301 so as to be arranged in this order from the left.

Each of the cables 302 is connected to a corresponding one of the slots 301. For easy connection, the print labels L are attached to end portions of the respective cables 302 such that the same character strings R as the respective identification names of the slots 301 are printed on the respective print labels L to indicate the corresponding slots 301. That is, the print labels L on which the same texts as the identification names of the plates PL are printed are attached to the respective cables 302 to indicate which slot 31 each cable 302 is to be connected to. This configuration clarifies a relationship between the slots 301 and the cables 302, thereby preventing erroneous connection.

Figure 6A:
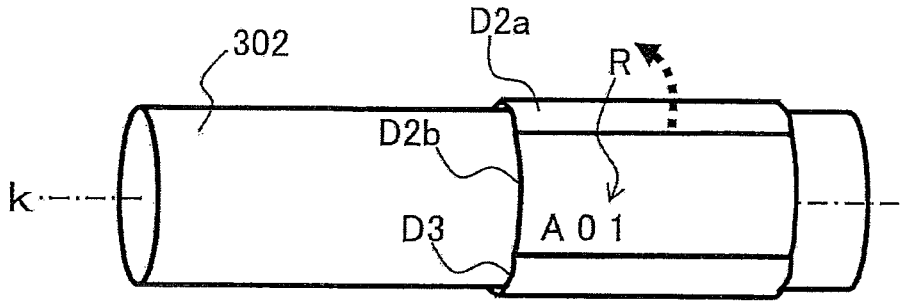
FIGS. 6A and 6B are schematic views each illustrating a state in which the print label is attached to the wrapped member (a cable)
Figure 6B:
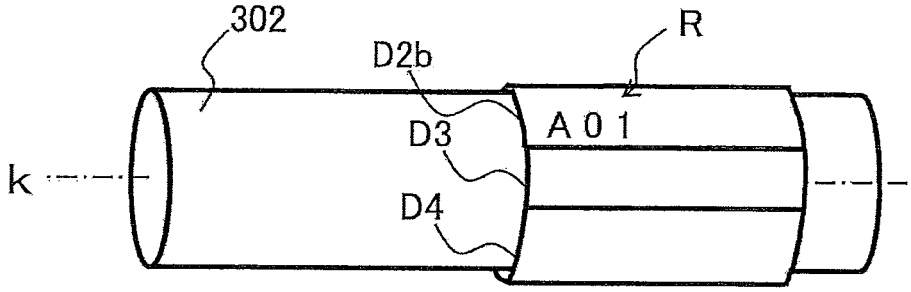

Each of FIGS. 6A and 6B schematically illustrates a state in which the print label L is attached to the cable 302. FIGS. 6A and 6B also illustrate axes k of the cables 302. As described above, the print label L is rotatably attached to the cable 302 as the wrapped member. In the state illustrated in FIG. 6A, for example, the print label L is in a state in which the non-adhesive region D2*b* in which the character string R representing "A01" is printed is on a front side in FIG. 6A. It is noted that the transparent adhesive region D5 covers the outer circumferential portion of the non-adhesive region D2*b* in reality as illustrated in FIG. 4C, but illustration of the transparent adhesive region D5 is omitted in FIGS. 6A and 6B for simplicity. When the print label L is rotated in a direction indicated by the broken-line arrow (i.e., in the circumferential direction) from the state illustrated in FIG. 6A, for example, the non-adhesive regions D3, D4 of the print label L is located on the front side as illustrated in FIG. 6B. In the case where the print label L is fixed to the cable 302 at the position in FIG. 6B, the viewability of the character string R is low. However, since the print label L is rotatable in this example, the viewability of the character string R is increased by rotating the print label L in a direction reverse to the above-described direction to the position in FIG. 6A.

Occurrence of Misalignment in Sticking

As described above, the print label L is attached to the wrapped member 302 by being rotatably wrapped around the wrapped member 302. Since this operation is performed manually by the user, the portion of the adhesive layer 22 in the adhesive region D1 and the portion of the non-adhesive layer 23 in the non-adhesive region D3 may be misaligned to each other in sticking in the second direction (in other words, the axial direction of the wrapped member 302), which may cause contact of the portion of the adhesive layer 22 in the adhesive region D5 with the wrapped member 302 when the above-described wrapping is finished as described above (see FIG. 4C). In the present embodiment, the adhesive region D5 is shaped so as to reduce this contact. There will be described this configuration in detail using comparative examples with reference to FIGS. 7A-9B. In FIGS. 7A-9B, scales and horizontal-to-vertical ratios of the regions, the marks, and so on are changed appropriately for simplicity and easy understanding.

First Comparative Example

Figures 7A, 7B:
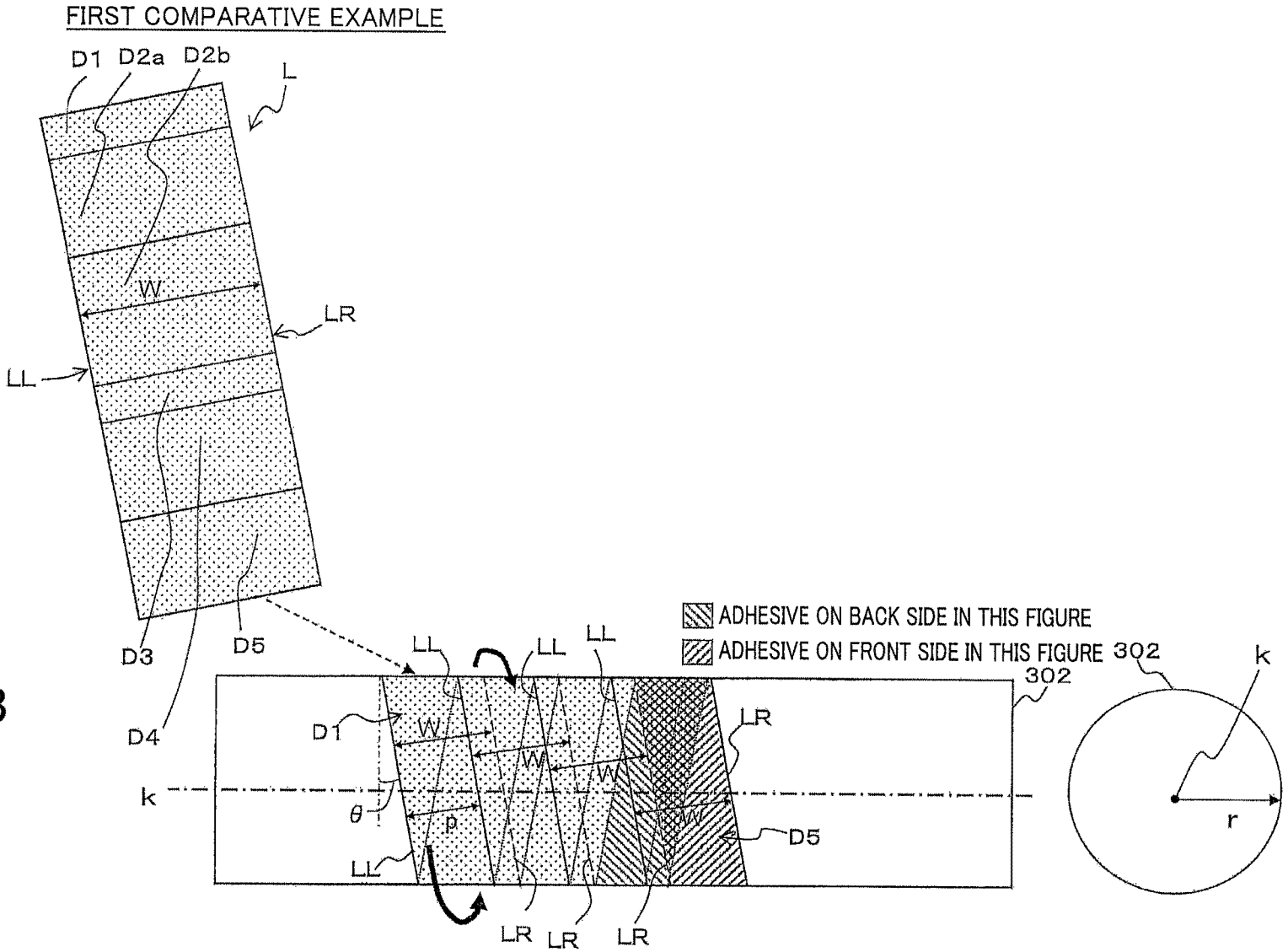
FIG. 7A is a developed plan view of a print label in a first comparative example of the one embodiment.
FIG. 7B is a schematic view illustrating a behavior in wrapping of the print label illustrated in FIG. 7A around the wrapped member in a state in which the print label is inclined.

There will be described a first comparative example of the present embodiment with reference to FIGS. 7A and 7B. FIG. 7A is a developed plan view of a print label L in the first comparative example. FIG. 7B is a schematic view illustrating a behavior in which the print label L illustrated in FIG. 7A is wrapped around the wrapped member 302 having the radius r. For simplicity, FIG. 7B omits detailed illustration of (i) inner-sides sticking of the sticking portion and the stuck portion of the print label L and (ii) folding of the sticking portion and the stuck portion stuck to each other, into the inner circumferential side, for example. This applies to FIGS. 8B and 9B.

In the first comparative example, as illustrated in FIGS. 7A and 7B, the adhesive region D5 of the print label L does not have an inverted isosceles trapezoid as in the present embodiment but has a substantially rectangular shape having the length W in the second direction like the adhesive region D1 and the non-adhesive regions D2-D4. It is assumed that, when the print label L is as illustrated in FIG. 7B attached so as to be wrapped around the wrapped member 302 in the order of the adhesive region D1, the non-adhesive region D2*a*, the non-adhesive region D2*b*, the non-adhesive region D3, and so on as described above, a misalignment occurs in a manual operation of the user, so that the direction of wrapping is inclined at the angle θ with respect to a direction orthogonal to the original axis k.

When the print label L is wrapped around the wrapped member 302 as described above in the state in which the direction of wrapping is inclined, as illustrated in FIG. 7B, the print label L is wrapped in the following wrapping manner: a one-side (left) edge portion LL of the print label L in the second direction (hereinafter may be referred to as "left edge portion LL") gradually deviates spirally with wrapping of the print label L around the wrapped member 302. In this example, the misalignment width (pitch) p in the spiral shape in wrapping is less than the length W of the print label in the second direction. Thus, an other-side (right in FIG. 7B) edge portion LR of the print label L in the second direction (hereinafter may be referred to as "right edge portion LR") is covered with the left edge portion LL and a portion of the print label L near the left edge portion LL which are thereafter wrapped one lap behind (see the long broken line in FIG. 7B), only the adhesive region D5 as a wrapping end and a portion of the right edge portion LR which is located near the adhesive region D5 are exposed (outward in the radial direction of the wrapped member 302) without being covered.

In this spiral wrapping manner, a region, as a wrapping end portion, indicated by left-inclined hatching in FIG. 7B (noted that this region corresponds to wrapping toward the front side of the wrapped member 302 in FIG. 7B, and the region may be hereinafter referred to as "left hatching region") and a region indicated by right-inclined hatching in FIG. 7B (noted that this region corresponds to wrapping toward the back side of the wrapped member 302 in FIG. 7B, and the region may be hereinafter referred to as "right hatching region") in the portion of the adhesive layer 22 in the adhesive region D5 are exposed inward in the radial direction (toward the wrapped member 302). This may lead to a case where adhesive on the left hatching region and the right hatching region contacts the wrapped member 302 when the wrapping of the print label L around the wrapped member 302 is finished.

Second Comparative Example

There will be described a second comparative example of the present embodiment with reference to FIGS. 8A and 8B. As in the first comparative example, FIG. 8A is a developed plan view of a print label L in the second comparative example, and FIG. 8B is a schematic view illustrating a behavior in which the print label L illustrated in FIG. 8A is wrapped around the wrapped member 302 having the radius r.

Figures 8A, 8B:
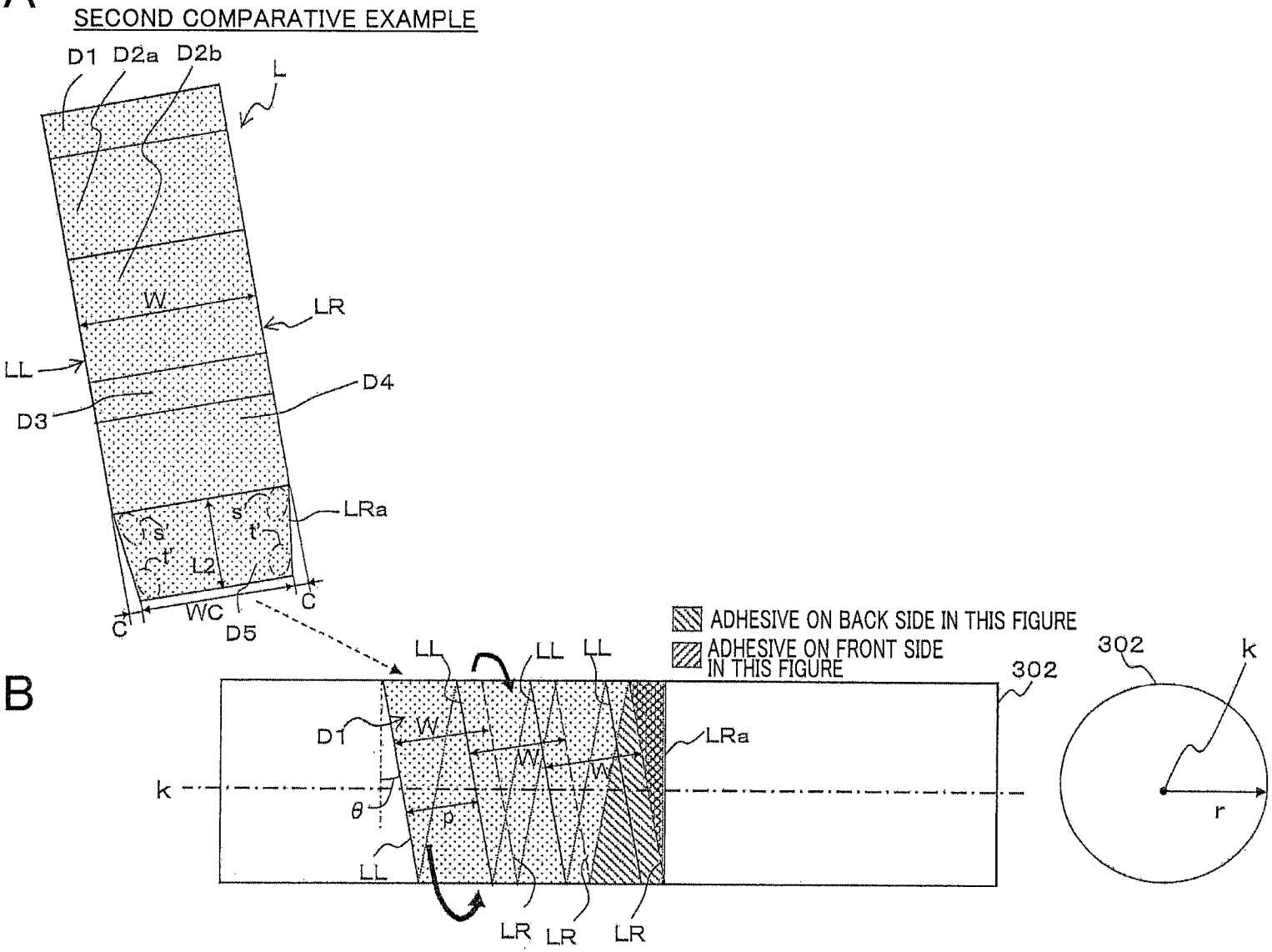
FIG. 8A is a developed plan view of a print label in a second comparative example of the one embodiment.
FIG. 8B is a schematic view illustrating a behavior in wrapping of the print label illustrated in FIG. 8A around the wrapped member in a state in which the print label is inclined.

In the second comparative example, as illustrated in FIGS. 8A and 8B, to reduce contact of the adhesive with the wrapped member 302, the length WC, in the second direction, of a one-side end portion (a lower end portion in FIG. 8A) of the adhesive region D5 of the print label L in the first direction is less by the length 2C than the length W, in the second direction, of an other-side end portion (an upper end portion in FIG. 8A) of the adhesive region D5 of the print label L in the first direction. In other words, the adhesive region D5 has a shape formed by inverting, in the up and down direction, the isosceles trapezoid in which a deviation between the upper side (the length WC) and the lower side (the length W) is 2C.

In FIG. 8B, when the print label L having this configuration is wrapped around the wrapped member 302 in the state in which the direction of wrapping is inclined at the angle θ as described above, as in FIG. 7B illustrating the first comparative example, the print label L is wrapped such that the left edge portion LL gradually deviates spirally rightward in FIG. 8B. Since the adhesive region D5 as a wrapping end portion has a shape (the inverted isosceles trapezoid) with its length in the second direction decreasing gradually as described above, an edge portion LRa (a right edge portion in FIG. 8B) of the adhesive region D5 in this example extends in a direction orthogonal to the axis k when the wrapping is finished. With this shape, the area of the left hatching region and the right hatching region exposed to the wrapped member 302 as described above is reduced, for example about by half, when compared with that in the first comparative example. Since the adhesive is exposed inward in the radial direction (toward the wrapped member 302) at the remaining left and right hatching regions, however, when wrapping of the print label L around the wrapped member 302 is finished, there is a possibility of contact of the adhesive in these regions with the wrapped member 302.

Configuration and Effects in Embodiment

Figures 9A, 9B:
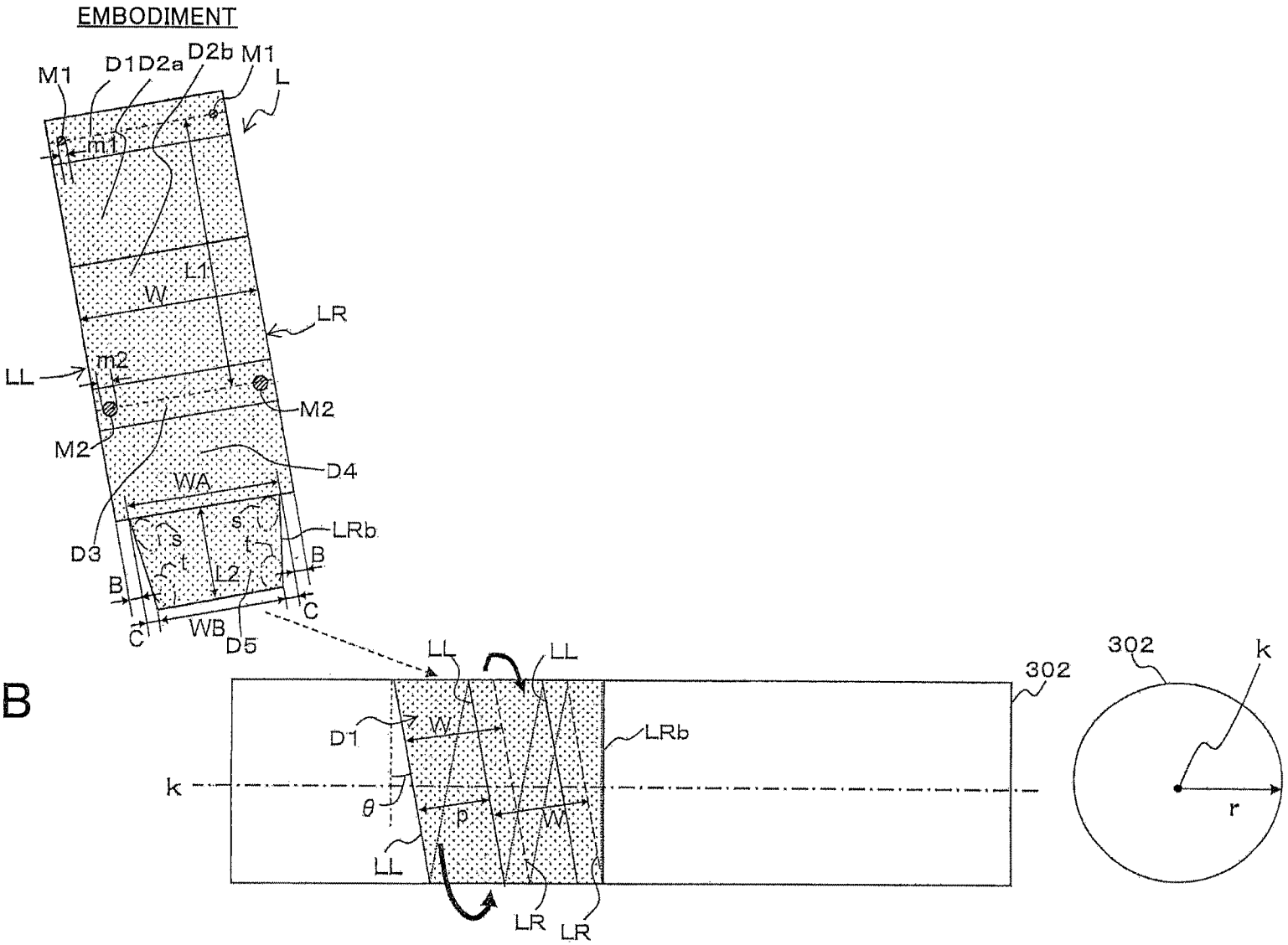
FIG. 9A is a developed plan view of a print label in the one embodiment.
FIG. 9B is a schematic view illustrating a behavior in wrapping of the print label illustrated in FIG. 9A around the wrapped member in a state in which the print label is inclined.

To solve this problem, in the present embodiment, as illustrated in FIG. 9A corresponding to FIGS. 7A and 8A, the adhesive region D5 is shaped like an inverted isosceles trapezoid which is similar to that in the second comparative example and in which the length of the upper side of the isosceles trapezoid in the second direction is less than the length of the upper side of the isosceles trapezoid in the second direction in the second comparative example.

That is, as illustrated in FIGS. 9A and 3A, the length WA, in the second direction, of an other-side end portion (an upper end portion in FIGS. 9A and 3A) of the adhesive region D5 in the first direction is less, by the length 2B, than the length W, in the second direction, of a one-side end portion (a lower end portion in FIGS. 9A and 3A) of the non-adhesive region D3 in the first direction (W−WA=2B). The length WB, in the second direction, of a one-side end portion (a lower end portion in FIG. 3A) of the adhesive region D5 in the first direction is less, by the above-described length 2C, than the length WA, in the second direction, of the other-side end portion (the upper end portion in FIG. 3A) of the adhesive region D5 in the first direction (WB−WA=2C). It is noted that the adhesive region D5 has the length L2 in the first direction.

The dimensions of the adhesive region D5 is set as described above. Thus, in the print label L in the present embodiment, as illustrated in FIG. 9B, a right edge portion LRb of the adhesive region D5 in FIG. 9B extends in the direction orthogonal to the axis k at the end of the wrapping as in the second comparative example. In addition, the above-described setting of the dimensions eliminates the regions (the left hatching region and the right hatching region) exposed to the wrapped member 302 in the adhesive region D5. This configuration can, as in the first comparative example and the second comparative example, reduce contact of the adhesive with the wrapped member 302 when wrapping of the print label L around the wrapped member 302 is finished. That is, misalignment corresponding to angles less than or equal to the angle θ can be allowed in attachment of the print label L performed by the user in the present embodiment.

In the present embodiment, in particular, as illustrated in FIGS. 9A and 3A, the marks M1 are provided in the adhesive region D1, and the marks M2 are provided in the non-adhesive region D3. This configuration visually guides the user such that the user performs the sticking so as to align each of the marks M1 and a corresponding one of the marks M2 to each other. The length m2 of each of the second marks M2 in the second direction is different from the length m1 of each of the first marks M1 in the second direction. In this example, the length m2 is greater than the length m1 (see FIG. 3A). The difference in size between the marks M1, M2 causes the user to visually recognize an allowable amount of displacement of the print label L in the second direction in the sticking. In this example, the dimensions of the portions of the print label L are set in advance such that the misalignment falls within the angles less than or equal to the angle θ by performing sticking so as to place the small marks M1 respectively on the inside of the large marks M2 (which will be described below).

In the present embodiment, in particular, in the case where the radius of the wrapped member 302 is defined as r (mm), the distance between the mark M1 and the mark M2 in the first direction is defined as L1 (mm), and half a difference between the length m1 (mm) of the mark M1 in the second direction and the length m2 of the mark M2 in the second direction, i.e., (m2−m1)/2 (noted that the difference is represented by (m1−m2)/2 in the case where the mark M1 is larger than the mark M2, and this applies to the expressions described below) is defined as A (mm), B (mm) that is half a deviation between (i) the length W, in the second direction, of the one-side end portion (the lower end portion in FIGS. 9A and 3A) of the non-adhesive region D3 in the first direction and (ii) the length WA, in the second direction, of the other-side end portion (the upper end portion in FIGS. 3A and 9A) of the adhesive region D5 in the first direction is set so as to satisfy a relationship represented by the following expression: $B>(A/L1)\times 2\pi r$ (Expression 1).

The technical significance of Expression 1 is as follows. That is, in the case where the above-described sticking is performed so as to align the mark M1 and the mark M2 different in size from each other as described above, when it is assumed that the greatest misalignment has occurred, the inclination of the print label L in this case is represented by A/L1 because the marks M1, M2 spaced apart from each other in the first direction at a distance of the length L1 are displaced by ±A in the second direction.

In the case where the length L2 of the adhesive region D5 in the second direction is equal to the circumference 2πr of the wrapped member 302 having the radius r (in other words, the above-described problem of contact of the adhesive due to the misalignment is to be solved by the dimension of the adhesive region D5), an amount of displacement that occurs when wrapping is performed by an amount corresponding to the circumference 2πr with the inclination of A/L1 is represented by (A/L1)×2πr.

Accordingly, in the case where the deviation B (=(W−WA)/2) representing a reduced dimension representing a difference between the adhesive region D5 and the non-adhesive region D4 is greater than the amount of displacement ((A/L1)×2πr), even if the print label L is wrapped around the wrapped member 302 in the state in which the print label L is inclined, the amount of displacement can be absorbed by the above-described reduced dimension. As a result, in the present embodiment, at least a wrapping-start-side side portion (see a region s in FIG. 9A, for example) of the adhesive region D5 is, unlike a portion of the print label in the second comparative example which is equivalent to at least the wrapping-start-side side portion in the present embodiment (see a region s' in FIG. 8A, for example), formed so as not to protrude from a portion of the print label L which is wrapped one lap behind the wrapping-start-side side portion, making it possible to reduce contact of the adhesive in the adhesive layer 22 with the wrapped member 302.

In the present embodiment, in particular, as illustrated in FIGS. 9A and 3A, when it is assumed that C (mm) represents half a deviation among (i) the length L2 (mm) of the adhesive region D5 in the first direction, (ii) the length WA (mm), in the second direction, of the other-side end portion (the upper end portion in FIGS. 3A and 9A) of the adhesive region D5 in the first direction, and (iii) the length WB, in the second direction, of the one-side end portion (the lower end portion in FIGS. 3A and 9A) of the adhesive region D5 in the first direction, C is set so as to satisfy a relationship represented by the following expression: C>(A/L1)×L2 (Expression 2).

The technical significance of Expression 2 is as follows. That is, when the inclination in the case where the greatest misalignment has occurred as described above is A/L1, an amount of displacement that occurs when wrapping is performed by the length L2 of the adhesive region D5 in the first direction with the inclination of A/L1 is represented by (A/L1)×L2.

In this case, while the wrapping-start-side side portion does not protrude from a portion of the print label L, which is wrapped one lap behind, by satisfaction of Expression 1 in the adhesive region D5, the deviation C (=(WA−WB)/2) representing the inclination of the diameter decreasing shape needs to be greater than the amount of displacement ((AU)×L2) in order to finish wrapping in the state in which the wrapping-start-side side portion does not protrude from the portion of the print label L in the adhesive region D5 (in other words, in order to keep, until the wrapping-end end portion is wrapped, the state in which the wrapping-start-side side portion does not protrude in the adhesive region D5 by the inclination of the diameter decreasing shape of the adhesive region D5 having the inverted isosceles trapezoid). That is, in the case where the expression "C>(A/L1)×L2" is satisfied, even when the print label L is wrapped around the wrapped member 302 in the state in which the print label L is inclined, the inclination of the diameter decreasing shape of the adhesive region D5 can keep the state in which the amount of displacement is absorbed (throughout the adhesive region D5). As a result, in the present embodiment, even when the print label L is wrapped around the wrapped member 302 in the state in which the print label L is inclined as described above, the wrapping-end end portion (see a region t in FIG. 9A, for example) does not protrude from the portion of the print label L which is wrapped one lap behind the wrapping-end end portion, unlike a portion of the print label in the second comparative example which is equivalent to the wrapping-end end portion in the present embodiment (see a region t' in FIG. 8A, for example). This configuration reduces contact of the adhesive in the adhesive layer 22 with the wrapped member 302.

While the embodiment has been described above, it is to be understood that the disclosure is not limited to the details of the illustrated embodiment, but may be embodied with various changes and modifications, which may occur to those skilled in the art, without departing from the spirit and scope of the disclosure. There will be described modifications of the above-described embodiment. It is noted that the same reference numerals as used in the above-described embodiment are used to designate the corresponding elements of the modifications, and an explanation of which is simplified or dispensed with.

1. Case Where Reduced Length of Adhesive Region D1

Figure 10B:
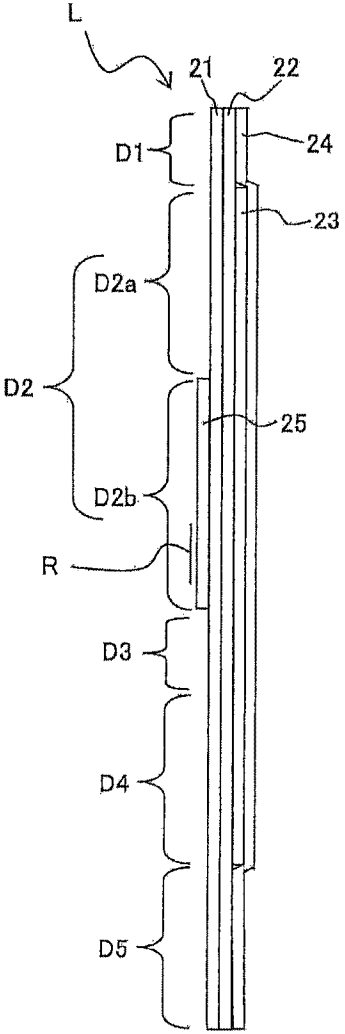
FIG. 10B is a cross-sectional view taken along line XB-XB in FIG. 10A.
Figure 10A:
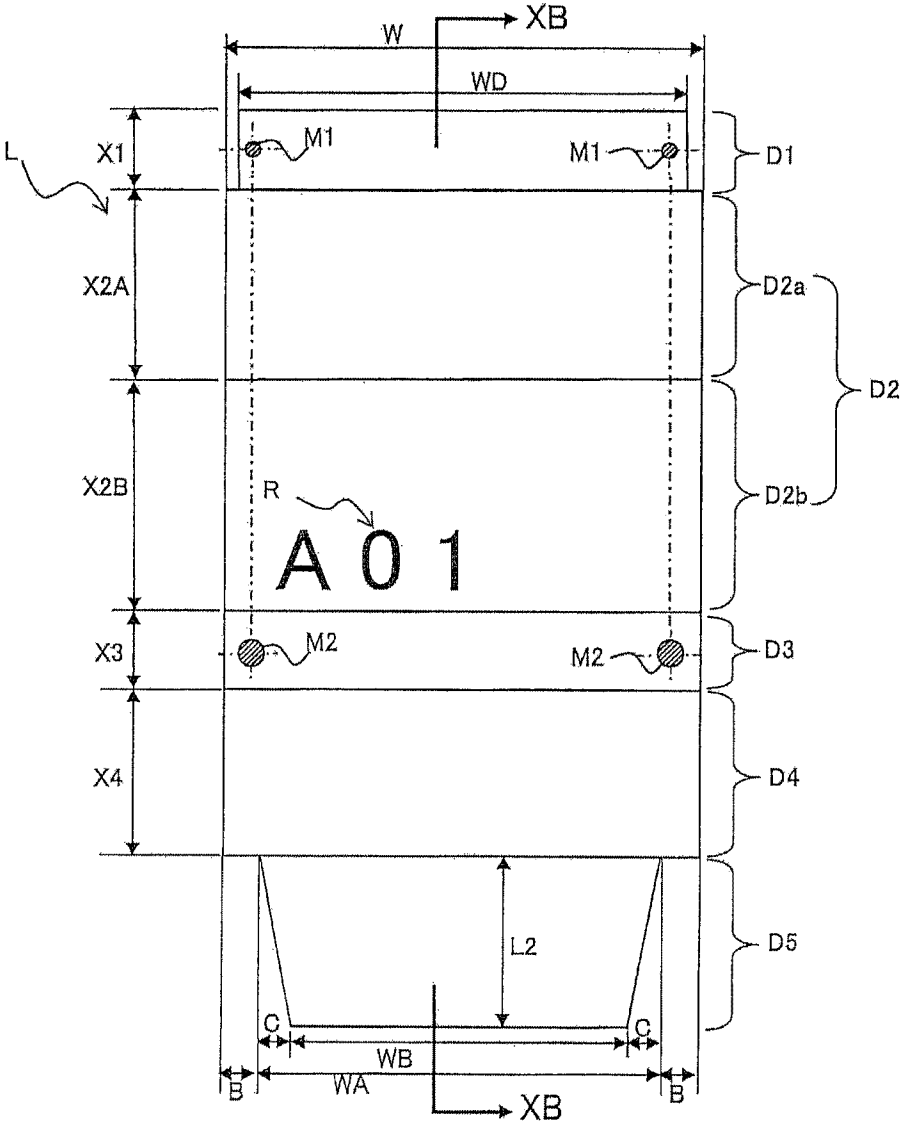
FIG. 10A is a developed plan view of a print label in a modification in which the length of an adhesive region D1 is reduced.

As illustrated in FIGS. 10A and 10B respectively corresponding to FIGS. 3A and 3B, the length WD of the adhesive region D1 in the second direction may be less than the length W of each of the non-adhesive region D2 and the non-adhesive region D3 in the second direction. The other configuration in this modification is similar to that illustrated in FIG. 3A.

The present modification achieves the same effects as achieved in the above-described embodiment. Also, the length WD of the adhesive region D1 is less than the length W of each of the non-adhesive region D2 and the non-adhesive region D3. Thus, even in the case where inner-sides sticking is performed between the adhesive region D1 and the non-adhesive region D3 in a state in which the wrapping direction is inclined as described above, it is possible to lower a possibility that the portion of the adhesive layer 22 in the adhesive region D1 protrudes from the non-adhesive region D3 as a stuck region.

Figure 11B:
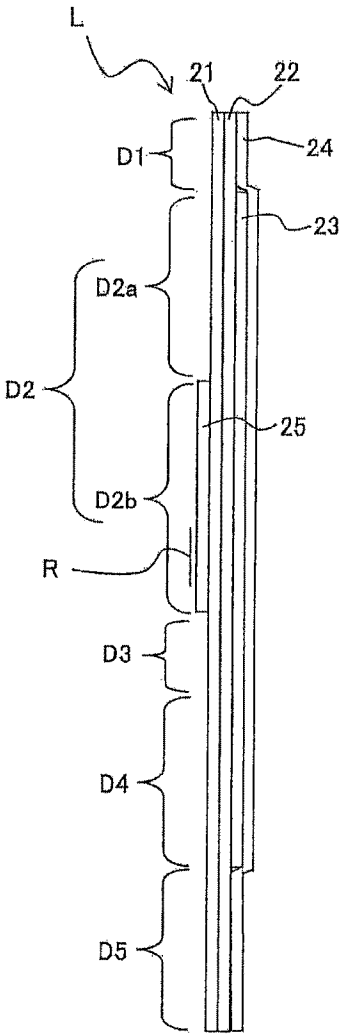
FIG. 11B is a cross-sectional view taken along line XIB-XIB in FIG. 11A.
Figure 11A:
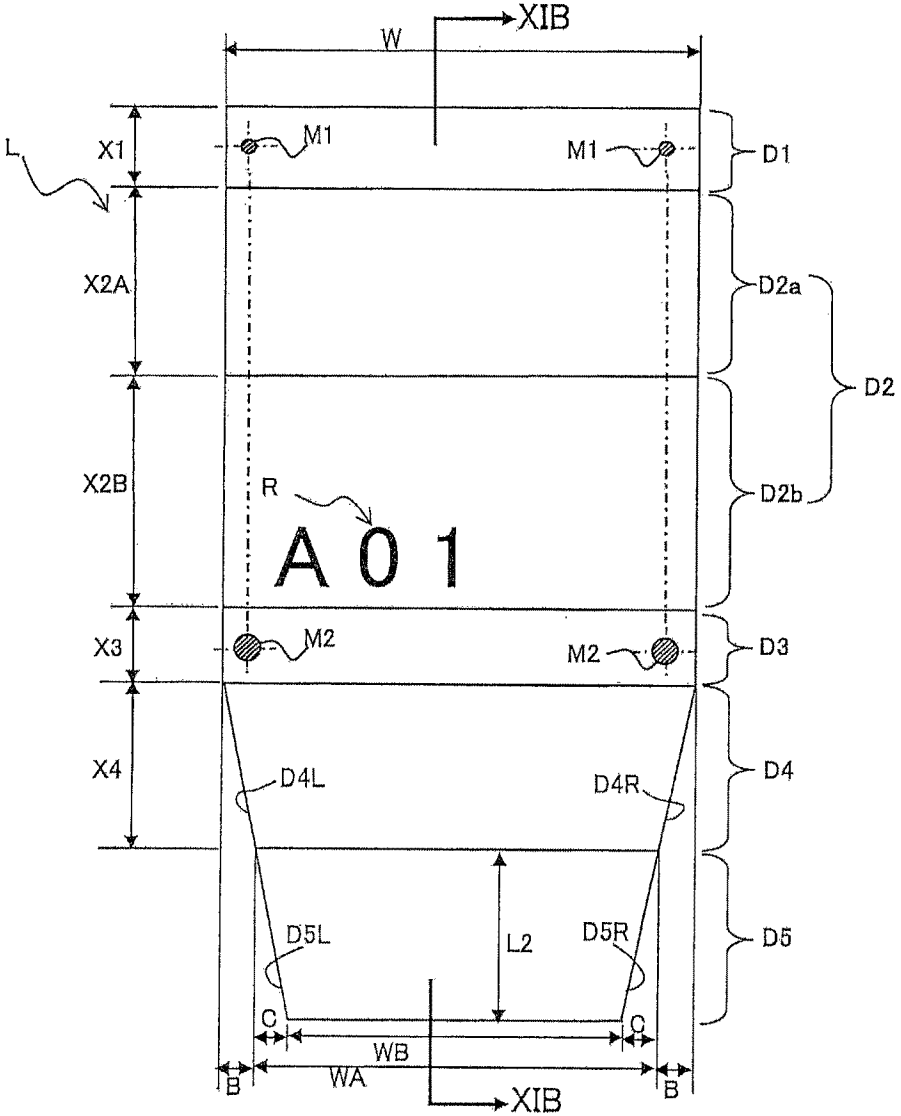
FIG. 11A is a developed plan view of a print label in a modification in which a non-adhesive region D4 also has an inverted isosceles trapezoid shape.

2. Case Where Non-adhesive Region D4 is Also Shaped Like Inverted Isosceles Trapezoid In the present modification, as illustrated in FIGS. 11A and 11B respectively corresponding to FIGS. 3A and 3B, the length, in the second direction, of a one-side end portion (a lower end portion in FIG. 11A) of the non-adhesive region D4 in the first direction is equal to the length WA, in the second direction, of the other-side end portion (the upper end portion in FIG. 11A) of the adhesive region D5 in the first direction. As a result, the length WA, in the second direction, of the one-side end portion (the lower end portion in FIG. 11A) of the non-adhesive region D4 in the first direction is less, by the length 2B, than the length W, in the second direction, of an other-side end portion (an upper end portion in FIG. 11A) of the non-adhesive region D4 in the first direction. That is, the non-adhesive region D4 has an inverted isosceles trapezoid shape with an upper side having the length WA and a lower side having the length W. Also, in this example, in particular, a one-side outer edge portion (a left outer edge portion in FIG. 11A) D4L of the non-adhesive region D4 in the second direction and a one-side outer edge portion (a left outer edge portion in FIG. 11A) D5L of the adhesive region D5 in the second direction are located on the same straight line, and an other-side outer edge portion (a right outer edge portion in FIG. 11A) D4R of the non-adhesive region D4 in the second direction and an other-side outer edge portion (a right outer edge portion in FIG. 11A) D5R of the adhesive region D5 in the second direction are located on the same straight line. The other configuration in this modification is similar to that illustrated in FIG. 3A.

The present modification achieves the same effects as achieved in the above-described embodiment.

Figure 12B:
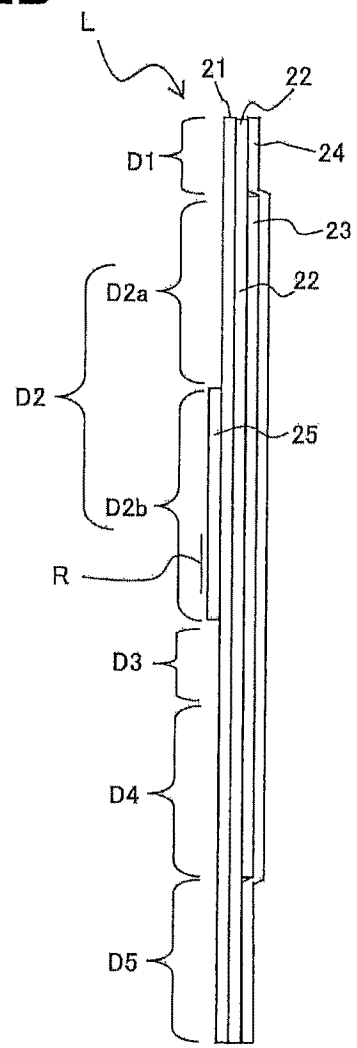
FIG. 12B is a cross-sectional view taken along line XIIB-XIIB in FIG. 12A.
Figure 12A:
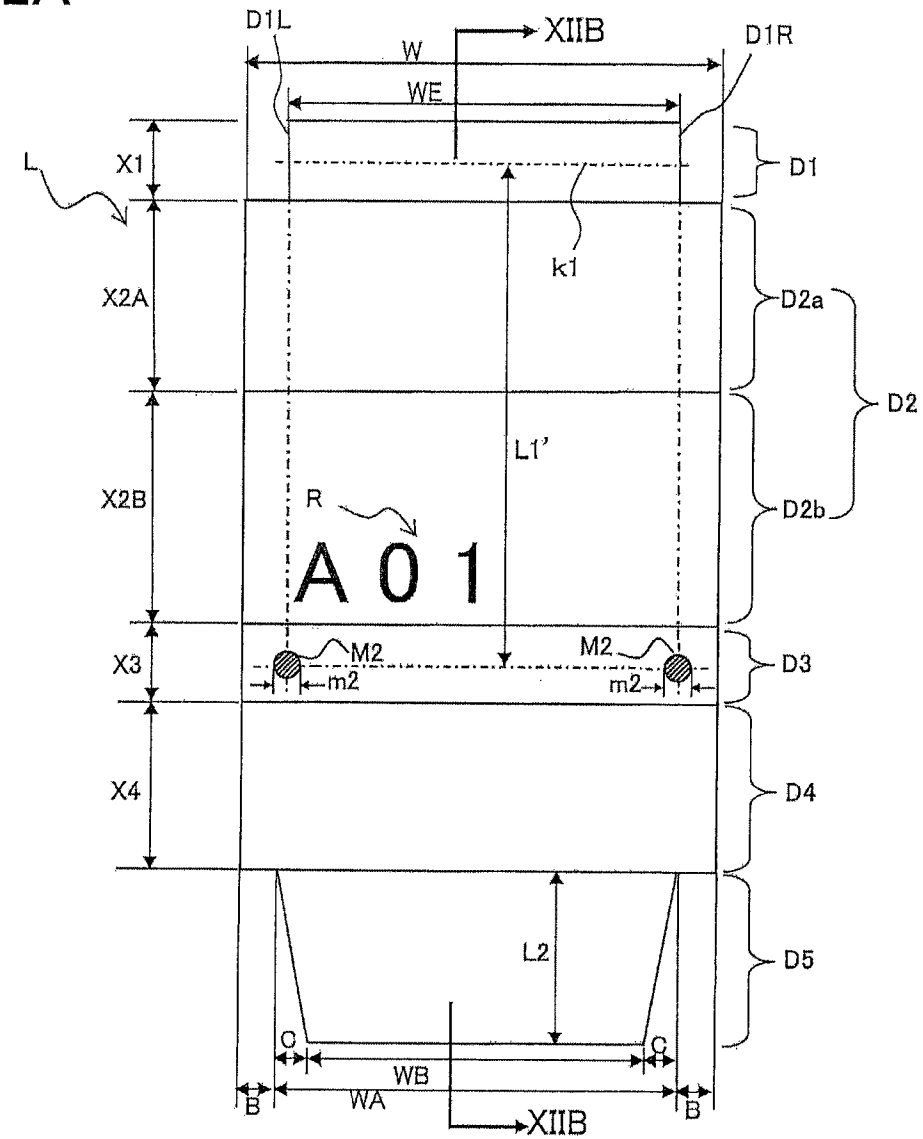
FIG. 12A is a developed plan view of the print label in a modification in which side edge portions of the adhesive region D1 and marks M2 are respectively aligned to each other.

3. Case Where Side Edge Portions of Adhesive Region D1 and Marks M2 are Respectively Aligned In the present modification, as illustrated in FIGS. 12A and 12B respectively corresponding to FIGS. 3A and 3B, the length WE of the adhesive region D1 in the second direction is less than the length W (in other words, the length of each of the non-adhesive regions D2, D3 in the second direction). Also, the first marks M1 are omitted.

A one-side edge portion (a left edge portion in FIG. 12A) D1L of the adhesive region D1 in the second direction and the center of the left second mark M2 in FIG. 12A are aligned in the up and down direction in FIG. 12A (i.e., the first direction). Likewise, an other-side edge portion (a right edge portion in FIG. 12A) D1R of the adhesive region D1 in the second direction and the center of the right second mark M2 in FIG. 12A are aligned in the up and down direction in FIG. 12A (i.e., the first direction). This configuration visually guides the user such that the user performs the inner-sides sticking so as to align each of the left and right edge portions D1L, D1R and a corresponding one of the marks M2 to each other.

The length m2 of each of the second marks M2 in the second direction is relatively large (see FIG. 12A). This size of the mark M2 causes the user to visually recognize an allowable amount of displacement of the print label L in the second direction in the sticking. In this example, the dimensions of the portions of the print label L are set in advance such that the misalignment falls within the angles less than or equal to the angle θ by performing sticking so as to place each of the left and right edge portions D1L, D1R on the inside of a corresponding one of the large marks M2.

In the present modification, in the case where the radius of the wrapped member 302 is defined as r (mm), the distance between each of the left and right edge portions D1L, D1R (specifically, a center line k1 of the left and right edge portions D1L, D1R in the first direction) and the corresponding one of the marks M2 in the first direction is L' (mm), and half the length m2 of each of the marks M2 in the second direction, i.e., m2/2, is defined as A' (mm), B (mm) that is half a deviation between (i) the length W, in the second direction, of the one-side end portion (the lower end portion in FIG. 12A) of the non-adhesive region D3 in the first direction and (ii) the length WA, in the second direction, of the other-side end portion (the upper end portion in FIG. 12A) of the adhesive region D5 in the first direction is set so as to satisfy a relationship represented by the following expression: $B>(A'/L1')\times 2\pi r$ (Expression 3).

The technical significance of Expression 3 is as follows. That is, as in Expression 1, in the case where the above-described sticking is performed so as to align the left and right edge portions D1L, D1R and the respective marks M2 as described above, when it is assumed that the greatest misalignment has occurred, the inclination of the print label L in this case is represented by A'/L1' because each of the left and right edge portions D1L, D1R and the corresponding one of the marks M2 which are spaced apart from each other in the first direction at a distance of the length L1' are displaced by ±A' in the second direction. As in the above-described case, in the case where the length L2 of the adhesive region D5 in the second direction is equal to the circumference 2πr of the wrapped member 302 having the radius r, an amount of displacement that occurs when wrapping is performed by an amount corresponding to the circumference 2πr with the inclination of A'/L1' is represented by $(A'/L1')\times 2\pi r$.

Accordingly, in the case where the deviation B (=(W−WA)/2) representing a reduced dimension representing a difference between the adhesive region D5 and the non-adhesive region D4 is greater than the amount of displacement ($(A'/L1')\times 2\pi r$), even if the print label L is wrapped around the wrapped member 302 in the state in which the print label L is inclined, the amount of displacement can be absorbed by the above-described reduced dimension. As a result, in the present modification, as in the above-described embodiment, at least the wrapping-start-side side portion of the adhesive region D5 is formed so as not to protrude from a portion of the print label L which is wrapped one lap behind the wrapping-start-side side portion, making it possible to reduce contact of the adhesive in the adhesive layer 22 with the wrapped member 302.

In the present modification, as illustrated in FIG. 12A, when it is assumed that C (mm) represents half a deviation among (i) the length L2 (mm) of the adhesive region D5 in the first direction, (ii) the length WA (mm), in the second direction, of the other-side end portion (the upper end portion in FIG. 12A) of the adhesive region D5 in the first direction, and (iii) the length WB, in the second direction, of the one-side end portion (the lower end portion in FIG. 12A) of the adhesive region D5 in the first direction, C is set so as to satisfy a relationship represented by the following expression: $C>(A'/L1')\times L2$ (Expression 4).

The technical significance of Expression 4 is as follows. That is, as in Expression 2, when the inclination in the case where the greatest misalignment has occurred as described above is A'/L1', an amount of displacement that occurs when wrapping is performed by the length L2 of the adhesive region D5 in the first direction with the inclination of A'/L1' is represented by $(A'/L1')\times L2$.

In this case, while the wrapping-start-side side portion does not protrude from a portion of the print label L, which is wrapped one lap behind, by satisfaction of Expression 3 in the adhesive region D5, the deviation C (=(WA−WB)/2) representing the inclination of the diameter decreasing shape needs to be greater than the amount of displacement ($(A'/L1')\times L2$) in order to finish wrapping in the state in which the wrapping-start-side side portion does not protrude from the portion of the print label L in the adhesive region D5. That is, in the case where the expression "$C>(A'/L1')\times L2$" is satisfied, even when the print label L is wrapped around the wrapped member 302 in the state in which the print label L is inclined, the inclination of the diameter decreasing shape of the adhesive region D5 can keep the state in which the amount of displacement is absorbed. As a result, in the present modification, even when the print label L is wrapped around the wrapped member 302 in the state in which the print label L is inclined as described above, the wrapping-end end portion does not protrude from the portion of the print label L which is wrapped one lap behind the wrapping-end end portion. This configuration reduces contact of the adhesive in the adhesive layer 22 with the wrapped member 302.

4. Variations of Shape of Adhesive Region D1

Figure 13B:
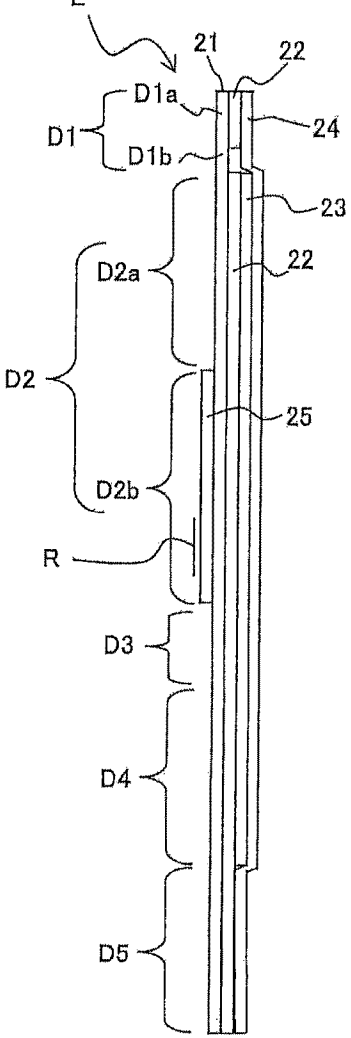
FIG. 13B is a cross-sectional view taken along line XIIIB-XIIIB in FIG. 13A.
Figure 13A:
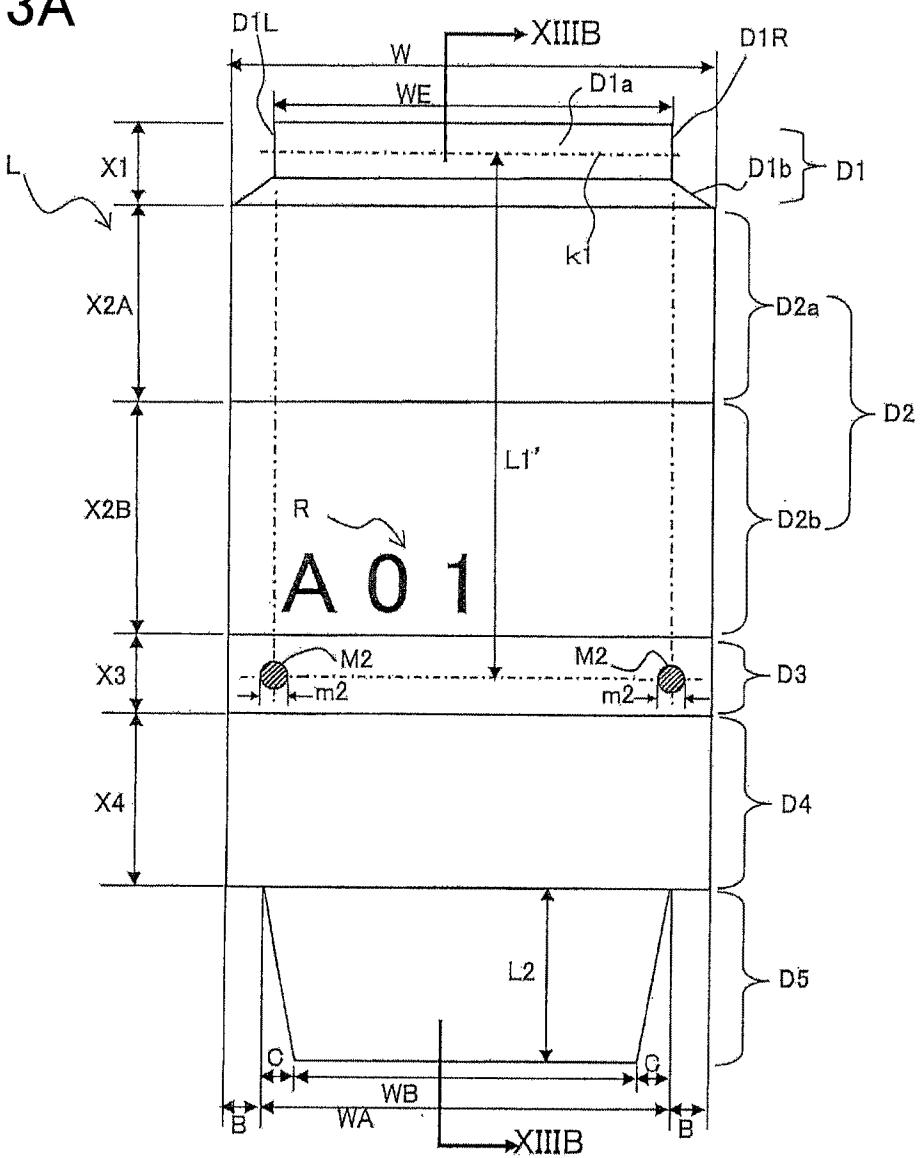
FIG. 13A is a developed plan view of a print label in a modification in which an adhesive region D1 has another shape.

In the present modification, as illustrated in FIGS. 13A and 13B, the adhesive region D1 is constituted by a rectangular adhesive portion D1*a* (as another example of the first region) and a surface portion D1*b* located contiguous to and on the one side of the adhesive portion D1*a* in the first direction. The surface portion D1*b* has a trapezoid shape having side edges each extending outward.

In the adhesive portion D1*a*, the base layer 21, the adhesive layer 22, and the separation layer 24 are stacked in this order from the left side toward the right side in FIG. 13B. The entire portion of the print label L in the adhesive portion D1*a* which portion is in contact with the separation layer 24 has adhesiveness. In the surface portion D1*b*, in contrast, the base layer 21 and the separation layer 24 are stacked in this order from the left side toward the right side in FIG. 13B without the adhesive layer 22. The entire portion of the print label L in the surface portion D1*b* which portion is in contact with the separation layer 24 does not have adhesiveness. It is noted that the adhesive layer 22 in the adhesive portion D1*a* may be provided only in right and left portions of the adhesive portion D1*a* in FIG. 13A (in other words, the adhesive layer 22 in the adhesive portion D1*a* may not be provided at an intermediate portion of the adhesive portion D1*a* in the right and left direction in FIG. 13A). The adhesive portion D1*a* has the length WE in the second direction. This length WE is less than the length W that is the largest length of the adhesive region D1 in the second direction.

As in the modification illustrated in FIGS. 12A and 12B, a one-side edge portion (a left edge portion in FIG. 13A) D1L of the adhesive region D1*a* in the second direction and the center of the left second mark M2 in FIG. 13A are aligned in the up and down direction in FIG. 13A (i.e., the first direction), and an other-side edge portion (a right edge portion in FIG. 13A) D1R of the adhesive region D1*a* in the second direction and the center of the right second mark M2 in FIG. 13A are aligned in the up and down direction in FIG. 13A (i.e., the first direction). The dimensions of the portions of the print label L are set in advance such that the misalignment falls within the angles less than or equal to the angle θ by performing sticking so as to place each of the left and right edge portions D1L, D1R on the inside of a corresponding one of the large marks M2 as in the above-described modification.

In the present modification, as in the modification illustrated in FIGS. 12A and 12B, in the case where the radius of the wrapped member 302 is defined as r (mm), the distance between each of the left and right edge portions D1L, D1R (specifically, a center line k1 of the left and right edge portions D1L, D1R in the first direction) and the corresponding one of the marks M2 in the first direction is L' (mm), and half the length m2 of each of the marks M2 in the second direction, i.e., m2/2, is defined as A' (mm), B (mm) that is half a deviation between the length W (mm) and the length WA (mm) is set so as to satisfy a relationship represented by the following expression: $B>(A'/L1')\times 2\pi r$ (Expression 3).

Likewise, when it is assumed that C (mm) represents half a deviation among (i) the length L2 (mm) of the adhesive region D5, (ii) the length WA (mm) of the other-side end portion (the upper end portion in FIG. 13A) of the adhesive region D5 in the first direction, and (iii) the length WB of the one-side end portion (the lower end portion in FIG. 13A) of the adhesive region D5 in the first direction, C is set so as to satisfy a relationship represented by the following expression: $C>(A'/L1')\times L2$ (Expression 4).

The present modification achieves the same effects as achieved in the modification illustrated in FIGS. 12A and 12B.

5. Case Where the Present Disclosure is Applied to Self-Laminate Type

Type of the wrapping manner in which the print label L is wrapped around the wrapped member 302 as described above includes what is called a self-laminate wrapping manner in which the print label L is wrapped not rotatably with respect to the wrapped member 302, in addition to a rotationally wrapping manner in which the print label L is wrapped rotatably with respect to the wrapped member 302 as in the above-described embodiment and modifications.

Figures 14A, 14B, 14C:
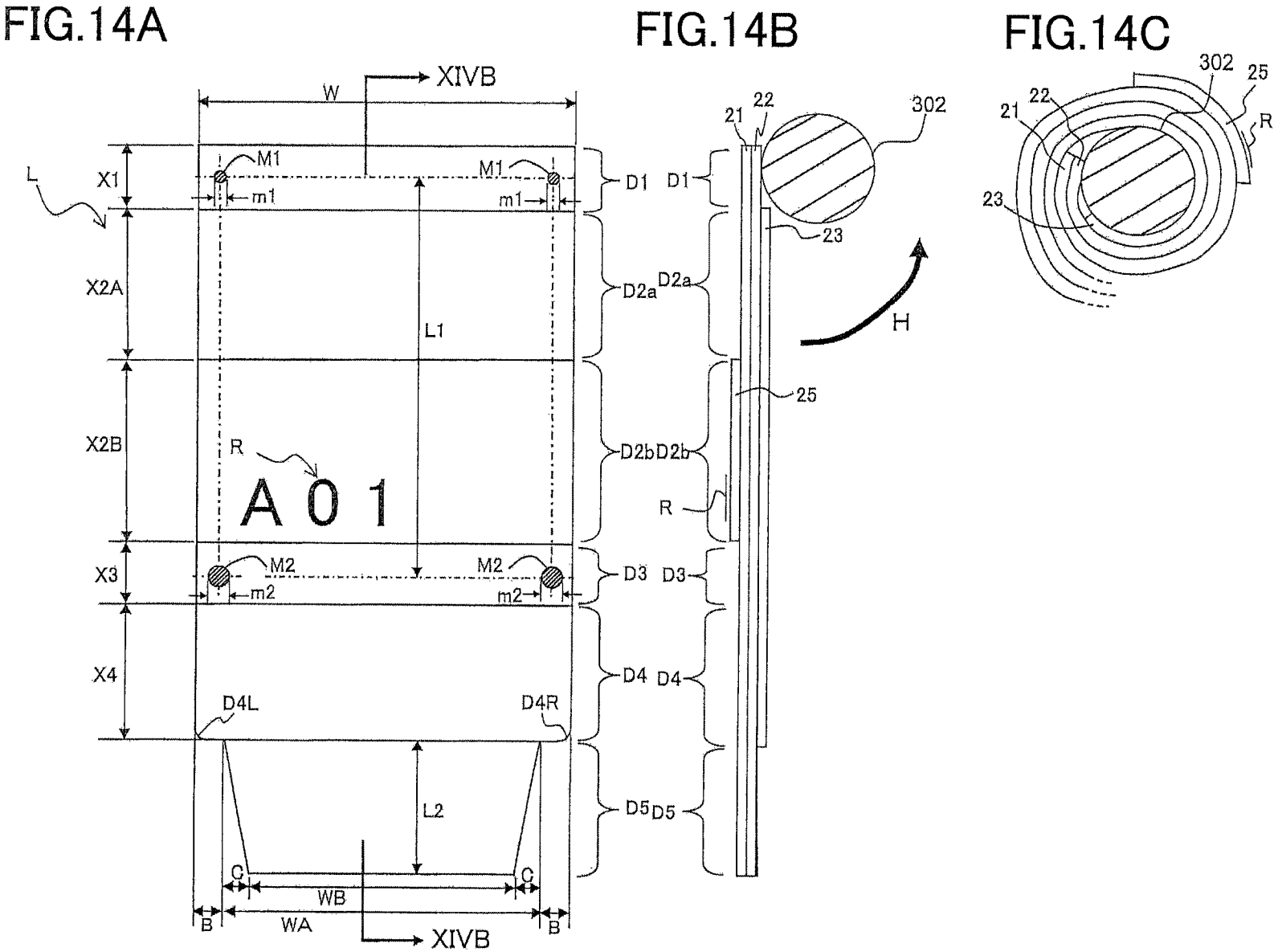
FIG. 14A is a developed plan view of a print label in a modification in which the print label is applied to a self-laminate type.
FIG. 14B is a cross-sectional view taken along line XIVB-XIVB in FIG. 14A.
FIG. 14C is a view for explaining a procedure of attachment of the print label to a wrapped member.

For example, one example of a case where the print label L having a configuration illustrated in FIGS. 3A and 3B is used in the self-laminate wrapping manner is described with reference to FIG. 14A identical in configuration to FIG. 3A, FIG. 14B identical in configuration to FIG. 3B, and FIG. 14C. As illustrated in FIG. 14A-14C, the print label L in this example is equivalent in configuration to that illustrated in FIGS. 3A and 3B. When the print label L is attached to the wrapped member 302, as illustrated in FIGS. 14B and 14C, the separation layer 24 is peeled off, and then a back surface (a right surface in FIG. 14B) of a portion of the base layer 21 in the adhesive region D1 is bonded to the wrapped member 302 via the adhesive layer 22. Thereafter, the portions of the print label L in the non-adhesive region D2*a*, the non-adhesive region D2*b*, the non-adhesive region D3, the non-adhesive region D4, and the adhesive region D5 are circumferentially rolled around the wrapped member 302 in this order (see the arrow H in FIG. 14B), and, in the last part of wrapping, a back surface (a right surface in FIG. 14B) of a portion of the base layer 21 in the adhesive region D5 is bonded via the adhesive layer 22 to a portion of the print label L in the non-adhesive region D2*a*, the non-adhesive region D2*b*, or the non-adhesive region D3, which portion has already wrapped around the wrapped member 302. In this case, since the portion of the base layer 21 in the adhesive region D1 is bonded to the wrapped member 302 via the adhesive layer 22, the print label L is not rotatable with respect to the wrapped member 302.

The above-described misalignment due to manual operation of the user may occur in the above-described bonding manner. To solve this problem, in the present modification, the length WA of an other-side end portion (an upper end portion in FIG. 14A) of the adhesive region D5 in the first direction is less, by the length 2B, than the length W of a one-side end portion (a lower end portion in FIG. 14A) of the non-adhesive region D3 in the first direction (W−WA=2B). The length WB of a one-side end portion (a lower end portion in FIG. 14A) of the adhesive region D5 in the first direction is less, by the length 2C, than the length WA of an other-side end portion (an upper end portion in FIG. 14A) of the adhesive region D5 in the first direction (WB−WA=2C). The dimensions of the adhesive region D5 is set as described above. Thus, as in the above-described embodiment, the print label L in the present modification eliminates the above-described regions (the left hatching region and the right hatching region illustrated in FIGS. 7B and 8B) in the adhesive region D5 which are exposed to the wrapped member 302 when the print label L is wrapped in the above-described manner. This configuration can, as in the above-described embodiment, reduce contact of the adhesive with the wrapped member 302 when wrapping of the print label L around the wrapped member 302 is finished. That is, misalignment corresponding to angles less than or equal to the angle θ can be allowed in attachment of the print label L performed by the user.

In the present modification, as in the above-described embodiment, the following relationship is satisfied: $B>(A/L1)\times 2\pi r$ (Expression 1). As a result, at least a wrapping-start-side side portion of the adhesive region D5 is formed so as not to protrude from a portion of the print label L which is wrapped one lap behind the wrapping-start-side side portion, making it possible to reduce contact of the adhesive in the adhesive layer 22 with the wrapped member 302.

Likewise, in the present modification, the following relationship is also satisfied: $C>(A/L1)\times L2$ (Expression 2). With this configuration, even when the print label L is wrapped around the wrapped member 302 in the state in which the print label L is inclined as described above, the wrapping-end end portion of the adhesive region D5 does not protrude from the portion of the print label L which is wrapped one lap behind the wrapping-end end portion. This configuration reduces contact of the adhesive in the adhesive layer 22 with the wrapped member 302.

6. Case Where Medium Body is Made Rotatable by Breakage Along Perforation

Figures 15A, 15B, 15C:
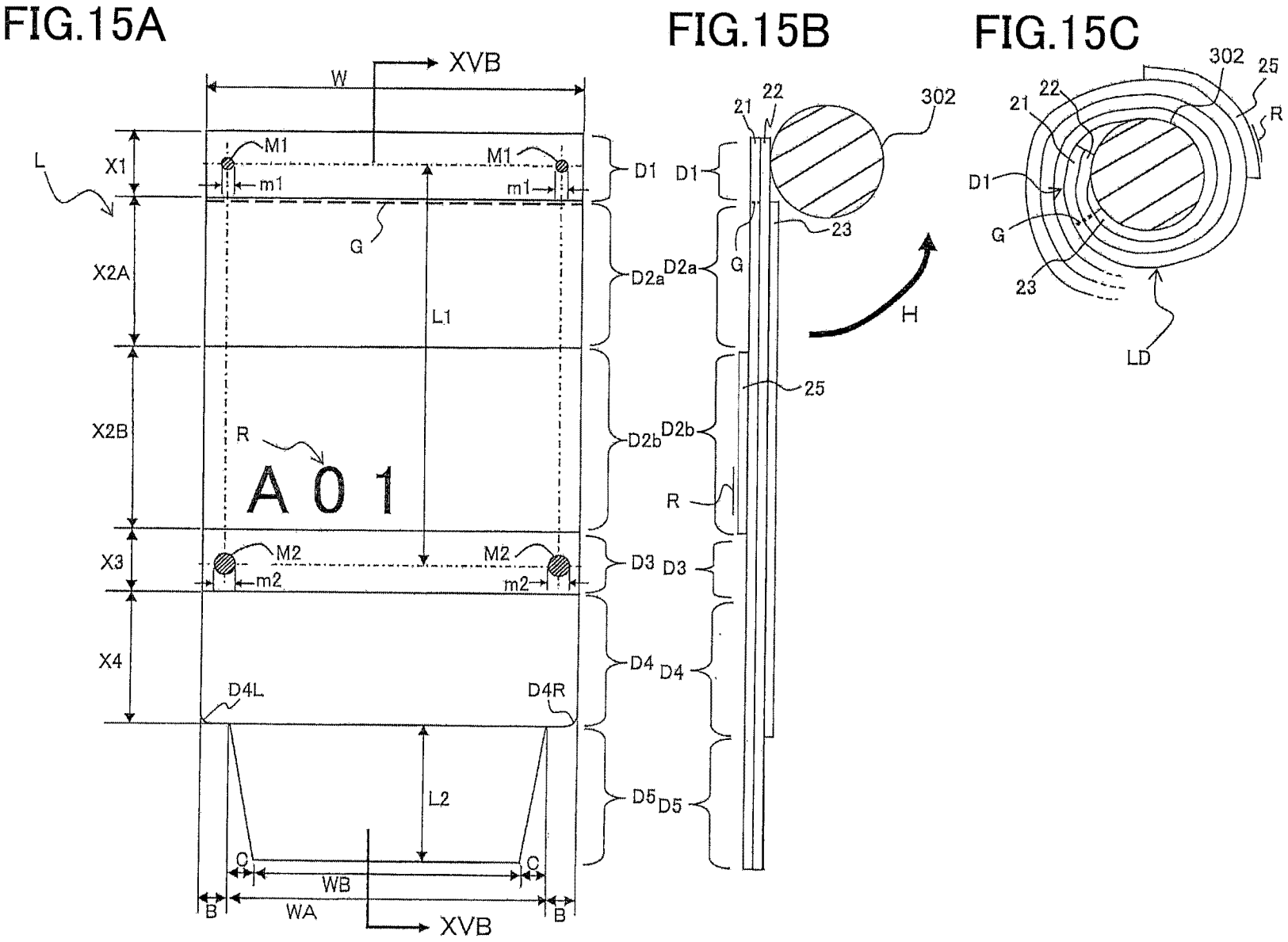
FIG. 15A is a developed plan view of the print label in a modification in which a print label is cut along perforation to make it rotatable.
FIG. 15B is a cross-sectional view taken along line XVB-XVB in FIG. 15A.
FIG. 15C is a view for explaining a procedure of attachment of the print label to a wrapped member.

In the present modification, as illustrated in FIGS. 15A-15C respectively corresponding to FIGS. 14A-14C, a series of narrow holes G (as one example of a breakable portion) arranged in the second direction (i.e., perforation) are formed in a portion of the base layer 21 in the non-adhesive region D2 at a position near a boundary between the non-adhesive region D2 and the adhesive region D1.

In the case of this print label L, as in the manner described above, a portion of the print label L in the adhesive region D1 is bonded to the wrapped member 302 via the adhesive layer 22. Thereafter, the portions of the print label L in the non-adhesive region D2*a*, the non-adhesive region D2*b*, the non-adhesive region D3, the non-adhesive region D4, and the adhesive region D5 are circumferentially rolled around the wrapped member 302 in this order, and then a portion of the print label L in the adhesive region D5 is bonded via the adhesive layer 22 to a portion of the print label L in the non-adhesive region D2*a*, the non-adhesive region D2*b*, or the non-adhesive region D3. The user thereafter manually tears off the print label L along the series of narrow holes G to separate the portions of the print label L in the non-adhesive regions D2*a*, D2*b*, the non-adhesive region D3, the non-adhesive region D4, and the adhesive region D5 (a medium body LD) from the portion of the print label L in the adhesive region D1 (see FIG. 15C). In this case, the non-adhesive portions of the print label L in the non-adhesive regions D2*a*, D2*b* and the non-adhesive region D3 are in contact with the wrapped member 302, whereby the medium body LD is rotatably attached to the wrapped member 302.

In the present modification, also in the case where the rotatable medium body LD is formed in this manner, the above-described configuration can reduce contact of the adhesive on the portion of the adhesive layer 22 in the adhesive region D5, with the wrapped member 302 when wrapping of the print label L around the wrapped member 302 is finished.

7. Other Modifications

In the above-described explanation, one example of the stickability is adhesion (adhesiveness) of the adhesive of the adhesive layer 22, but the present disclosure is not limited to this configuration. For example, the present disclosure may use various structures including: a pressure pseudo-adhesive structure which is used for, e.g., postcards and in which a pseudo-adhesive portion of the label cannot be stuck once peeled; and a structure in which portions of the label are stuck to each other by static electricity like a resin sheet used for, e.g., wrapping. For example, the pseudo-adhesive material may have such a property that the material is wet before sticking, and once dried and peeled, the material cannot be stuck again.

While the terms "orthogonal", "parallel", "plan", and the like are used in the above-described explanation, these terms are not strictly used. That is, tolerance and error in design and manufacture are allowed, and "orthogonal", "parallel", and "plan" may be respectively interpreted as "substantially orthogonal", "substantially parallel", and "substantially plan".

While the terms "the same", "equal", "different", and the like are used for dimensions and sizes in external appearance in the above-described explanation, these terms are not strictly used. That is, tolerance and error in design and manufacture are allowed, and "same", "equal", and "different" may be respectively interpreted as "substantially the same", "substantially equal", and "substantially different".

Each arrow in FIG. 1 indicates one example of a flow of signals and does not limit a direction or directions of the flow of the signals.

The techniques in the above-described embodiment and the modifications may be combined as needed.

The present disclosure is not limited to the details of the illustrated embodiment and modifications, but may be embodied with various changes and modifications, which may occur to those skilled in the art, without departing from the spirit and scope of the disclosure.

What is claimed is:

1. A medium, comprising a base layer, an adhesive layer, a non-adhesive layer, and a separation layer stacked on each other in a stacking direction, wherein a plurality of regions are defined in the medium along a first direction orthogonal to the stacking direction, wherein the plurality of regions comprise:

a first region in which the base layer, the adhesive layer and the separation layer are stacked in order from one side of the medium toward the other side of the medium in the stacking direction and in which a portion of the base layer is stickable with respect to the separation layer in at least a part of the first region in a second direction orthogonal to each of the stacking direction and the first direction;

a second region located on a first side of the first region in the first direction and in which the base layer, the adhesive layer, the non-adhesive layer and the separation layer are stacked in order from the one side toward the other side of the medium in the stacking direction, the first side being opposite to a second side in the first direction, a printing background layer being provided in the second region, a portion of the base layer, which is located in the second region, being non-stickable with respect to the separation layer;

a third region located on the first side of the second region in the first direction and in which the base layer, the adhesive layer and the separation layer are stacked in order from one side of the medium toward the other side of the medium in the stacking direction;

a fourth region located on the first side of the third region in the first direction and in which the base layer, the adhesive layer, the non-adhesive layer and the separation layer are stacked in order from the one side toward the other side of the medium in the stacking direction, a portion of the base layer, which is located in the fourth region, being non-stickable with respect to the separation layer; and a fifth region located on the first side of the fourth region in the first direction and in which the base layer, the adhesive layer and the separation layer are stacked in order from one side of the medium toward the other side of the medium in the stacking direction, a portion of the base layer, which is located in the fifth region, being stickable with respect to the separation layer, wherein a length, in the second direction, of a second-side end portion of the fifth region in the first direction is less than a length, in the second direction, of a first-side end portion of the third region in the first direction, and wherein a length, in the second direction, of a first-side end portion of the fifth region in the first direction is less than the length, in the second direction, of the second-side end portion of the fifth region in the first direction.

2. The medium according to claim 1, wherein a first mark is provided in the first region, and wherein a second mark is provided in the third region, and the second mark is aligned to the first mark in the first direction and is different from the first mark in length in the second direction.

3. The medium according to claim 2, wherein in a case where a radius of a wrapped member around which the medium is to be wrapped is defined as r, a distance between the first mark and the second mark in the first direction is defined as L1, half a difference between a length of the first mark in the second direction and a length of the second mark in the second direction is defined as A, and half a deviation between the length, in the second direction, of the first-side end portion of the third region in the first direction and the length, in the second direction, of the second-side end portion of the fifth region in the first direction is defined as B, B satisfies a following expression: $B>(A/L1)\times 2\pi r$.

4. The medium according to claim 3, wherein in a case where a length of the fifth region in the first direction is defined as L2, and half a deviation between the length, in the second direction, of the second-side end portion of the fifth region in the first direction and the length, in the second direction, of the first-side end portion of the fifth region in the first direction is defined as C, C satisfies a following expression: $C>(A/L1)\times L2$.

5. The medium according to claim 1, wherein a length of the first region in the second direction is less than a length of each of the second region and the third region in the second direction.

6. The medium according to claim 1, wherein a length of the first region in the second direction is less than a length of each of the second region and the third region in the second direction, and wherein a second mark is provided in the third region, and the second mark is aligned in the first direction to an edge portion of the first region in the second direction.

7. The medium according to claim 6, wherein in a case where a radius of a wrapped member around which the medium is to be wrapped is defined as r, a distance between the edge portion of the first region in the second direction and the second mark in the first direction is defined as L1', half a length of the second mark in the second direction is defined as A', and half a deviation between the length, in the second direction, of the first-side end portion of the third region in the first direction and the length, in the second direction, of the second-side end portion of the fifth region in the first direction is defined as B, B satisfies a following expression: $B>(A'/L1')\times 2\pi r$.

8. The medium according to claim 7, wherein in a case where a length of the fifth region in the first direction is defined as L2, and half a deviation between the length, in the second direction, of the second-side end portion of the fifth region in the first direction and the length, in the second direction, of the first-side end portion of the fifth region in the first direction is defined as C, C satisfies a following expression: $C>(A'/L1')\times L2$.

9. The medium according to claim 1, further comprising a breakable portion extending in the second direction and formed in a portion of the base layer in the second region at a position near a boundary between the second region and the first region.

* * * * *